US007096556B2

(12) United States Patent
Endo et al.

(10) Patent No.: US 7,096,556 B2
(45) Date of Patent: Aug. 29, 2006

(54) RECYCLING METHOD AND RECYCLING APPARATUS OF PART FOR IMAGE FORMING APPARATUS, AND RECYCLED PART FOR IMAGE FORMING APPARATUS

(75) Inventors: Miharu Endo, Minamiashigara (JP); Toshiaki Murofushi, Minamiashigara (JP); Fumitaka Nakajima, Minamiashigara (JP); Shinichiro Saito, Minamiashigara (JP); Jun Tsuda, Minamiashigara (JP); Masaharu Boshu, Minamiashigara (JP)

(73) Assignee: Fuji Xerox Co., LTD, Tokyo (JP)

( * ) Notice: Subject to any disclaimer, the term of this patent is extended or adjusted under 35 U.S.C. 154(b) by 525 days.

(21) Appl. No.: 10/368,404

(22) Filed: Feb. 20, 2003

(65) Prior Publication Data

US 2004/0039071 A1 Feb. 26, 2004

(30) Foreign Application Priority Data

Aug. 20, 2002 (JP) ..... 2002-239864

(51) Int. Cl.
*B07B 13/00* (2006.01)
*G03G 15/00* (2006.01)

(52) U.S. Cl. ..... 29/403.1; 29/402.06; 29/895.1; 156/94; 427/140; 521/40; 399/109

(58) Field of Classification Search ..... 29/895.1, 29/402.06, 403.1; 156/94, 95; 427/140, 427/142; 521/40; 399/109
See application file for complete search history.

(56) References Cited

U.S. PATENT DOCUMENTS

| | | | | |
|---|---|---|---|---|
| 5,550,617 | A * | 8/1996 | Odagawa et al. | 399/176 |
| 5,695,133 | A * | 12/1997 | Morse et al. | 241/42 |
| 6,029,031 | A * | 2/2000 | Yokomori et al. | 399/109 |
| 6,060,527 | A * | 5/2000 | Shinomiya et al. | 521/40 |
| 6,223,010 | B1 * | 4/2001 | Araki | 399/109 |
| 6,296,979 | B1 * | 10/2001 | Morita et al. | 430/69 |
| 2002/0106213 | A1 * | 8/2002 | Higeta et al. | 399/104 |
| 2005/0076487 | A1 * | 4/2005 | Koumura et al. | 29/403.1 |
| 2005/0115043 | A1 * | 6/2005 | Maeshima et al. | 29/402.08 |

FOREIGN PATENT DOCUMENTS

JP A 2001-013704 1/2001

* cited by examiner

*Primary Examiner*—Eric Compton
(74) *Attorney, Agent, or Firm*—Oliff & Berridge, PLC.

(57) ABSTRACT

A recycling method of a part for an image forming apparatus, the part being used in the image forming apparatus and provided with a thermoplastic resin member at least in a part thereof is provided which includes: recovering the part for the image forming apparatus; disassembling the recovered part for the image forming apparatus; retrieving the thermoplastic resin member from the disassembled part for the image forming apparatus; and performing heat processing to the retrieved thermoplastic resin member to recycle the member.

15 Claims, 37 Drawing Sheets

28 : TRACKING ROLL

FIG. 10
(A)
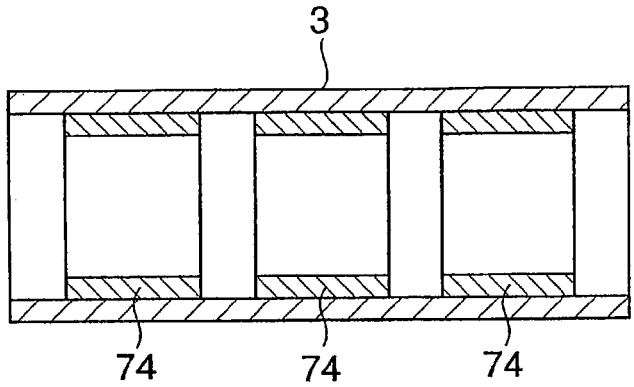
(B)
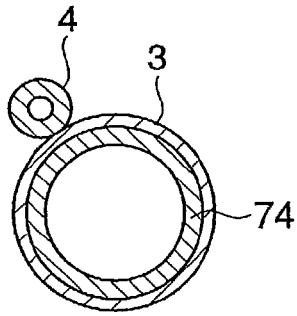
(C)
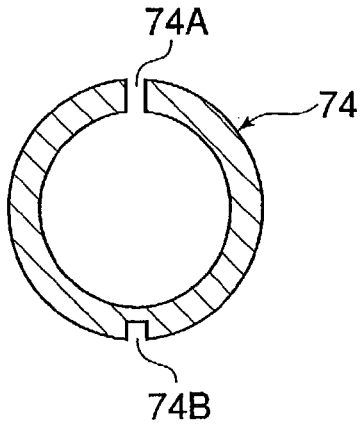

FIG. 11
(A)
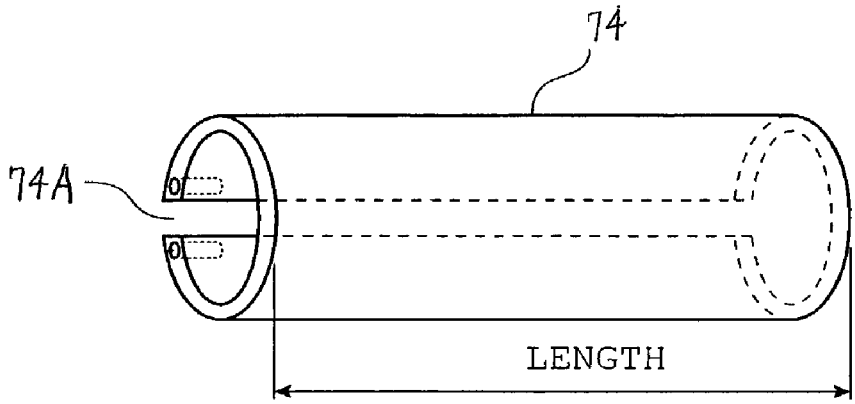
(B)
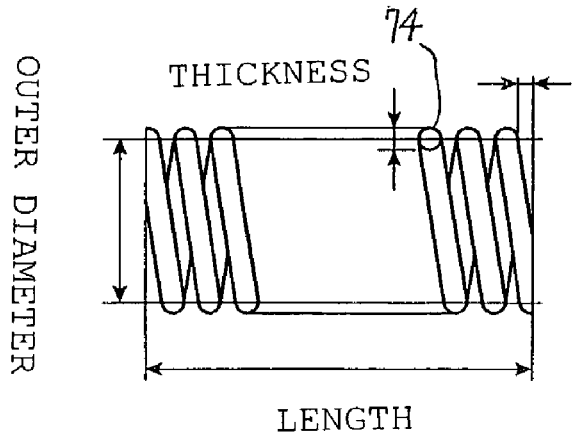

FIG. 13
(A)
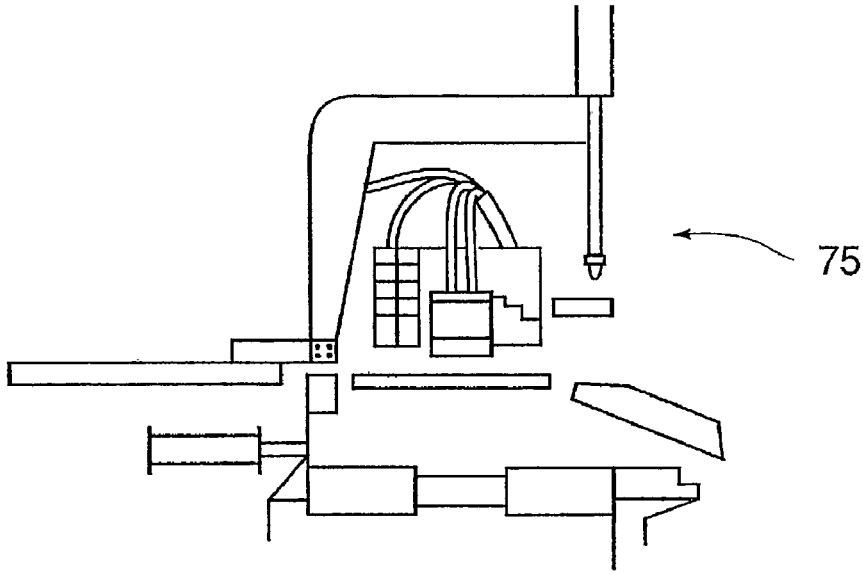
(B)
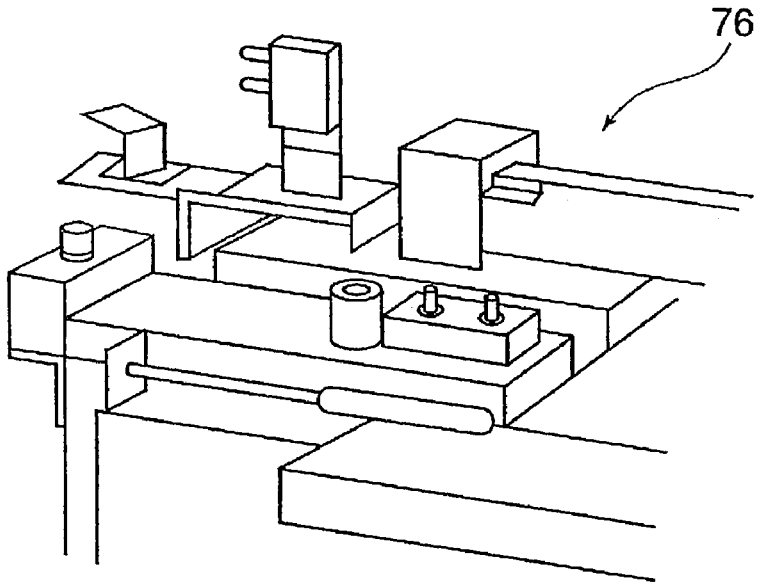

FIG. 21
(A)
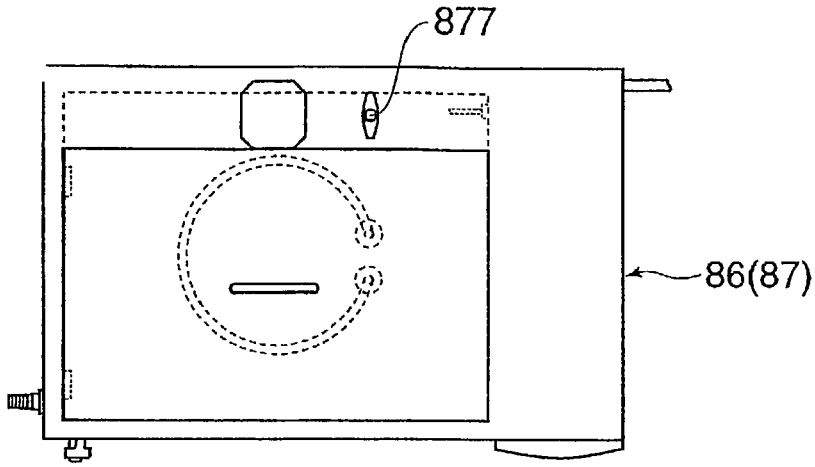
(B)
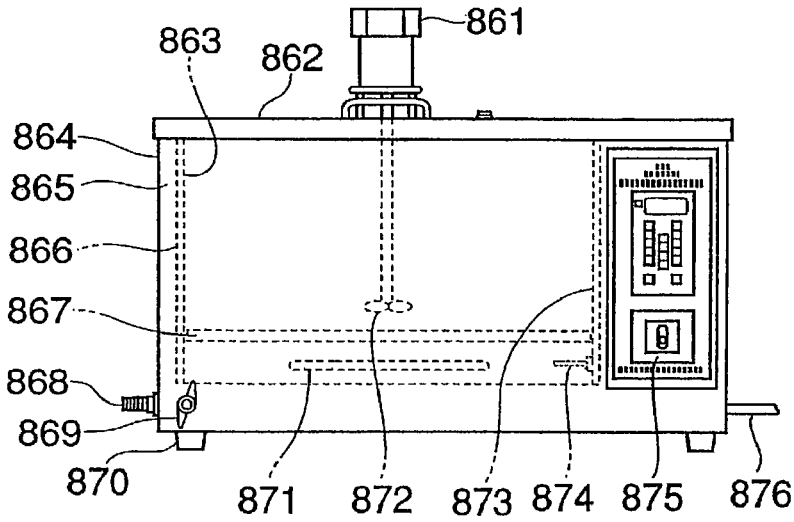
(C)
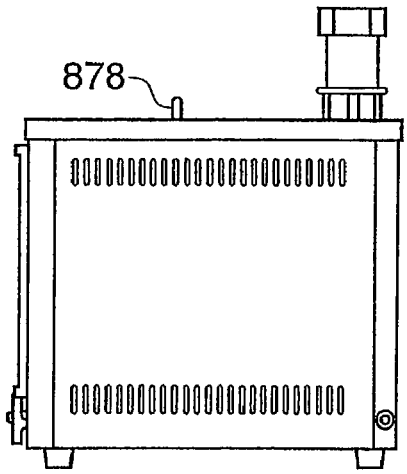

FIG. 26
(A)
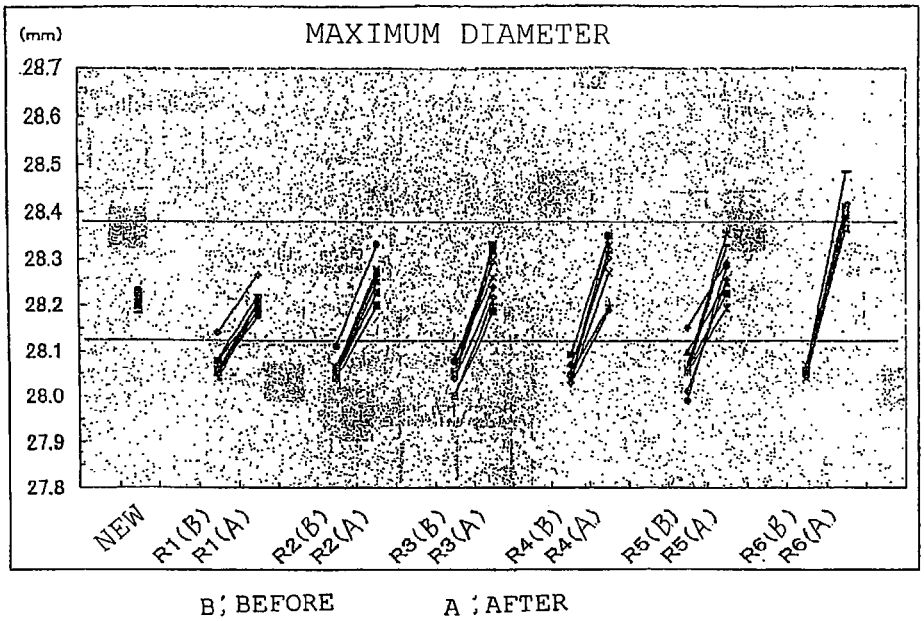
B; BEFORE A ; AFTER
(B)
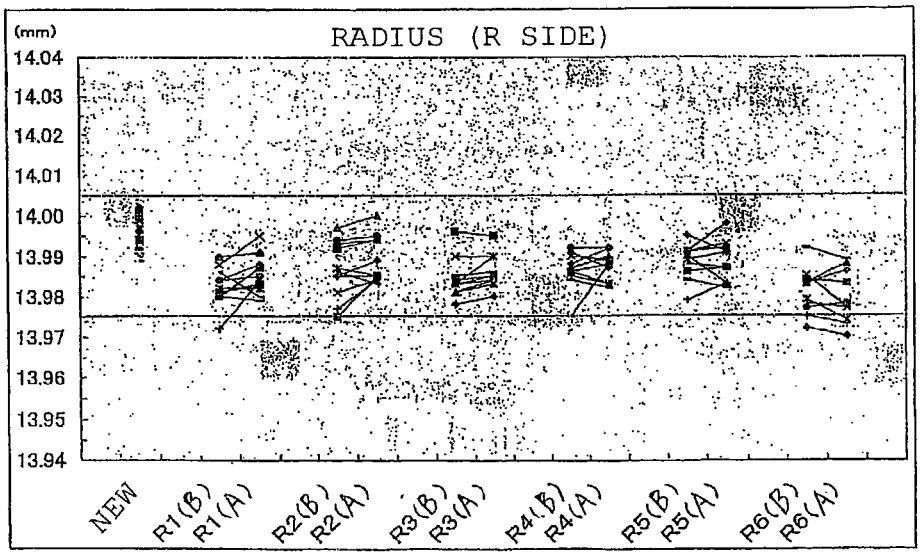
B; BEFORE A; AFTER

FIG. 27

| No | BEFORE TEST | AFTER TEST | DIFFERENCE | RECYCL'TIMES |
|---|---|---|---|---|
| 1 | 28.640 | 28.836 | 0.196 | 1 |
| 2 | 28.685 | 28.862 | 0.177 | 1 |
| 12 | 28.718 | 28.899 | 0.181 | 1 |
| 13 | 28.598 | 28.808 | 0.210 | 1 |
| 23 | 28.703 | 28.855 | 0.152 | 1 |
| 24 | 28.621 | 28.871 | 0.250 | 1 |
| 34 | 28.717 | 28.896 | 0.179 | 1 |
| 35 | 28.610 | 28.819 | 0.209 | 1 |
| 45 | 28.701 | 28.876 | 0.175 | 1 |
| 55 | 28.661 | 28.856 | 0.195 | 1 |
| 56 | 28.712 | 28.892 | 0.180 | 1 |
| AVE | 28.670 | 28.861 | 0.191 | |
| σ | 0.0455 | 0.0304 | 0.0256 | |
| 10 | 28.573 | 28.807 | 0.234 | 2 |
| 11 | 28.688 | 28.863 | 0.175 | 2 |
| 21 | 28.703 | 28.814 | 0.111 | 2 |
| 22 | 28.625 | 28.825 | 0.200 | 2 |
| 32 | 28.710 | 28.937 | 0.227 | 2 |
| 33 | 28.722 | 28.915 | 0.193 | 2 |
| 43 | 28.729 | 28.883 | 0.154 | 2 |
| 44 | 28.642 | 28.816 | 0.174 | 2 |
| 54 | 28.681 | 28.954 | 0.273 | 2 |
| 57 | 28.737 | 28.921 | 0.184 | 2 |
| 58 | 28.736 | 28.951 | 0.215 | 2 |
| AVE | 28.686 | 28.881 | 0.195 | |
| σ | 0.0525 | 0.0581 | 0.0433 | |
| 5 | 28.622 | 28.827 | 0.205 | 3 |
| 6 | 28.652 | 28.902 | 0.250 | 3 |
| 19 | 28.628 | 28.870 | 0.242 | 3 |
| 20 | 28.706 | 28.975 | 0.269 | 3 |
| 30 | 28.722 | 28.926 | 0.204 | 3 |
| 31 | 28.584 | 28.903 | 0.319 | 3 |
| 41 | 28.692 | 28.935 | 0.243 | 3 |
| 42 | 28.630 | 28.816 | 0.186 | 3 |
| 52 | 28.690 | 28.954 | 0.264 | 3 |
| 53 | 28.691 | 28.921 | 0.230 | 3 |
| 63 | 28.728 | 28.951 | 0.223 | 3 |
| AVE | 28.668 | 28.907 | 0.240 | |
| σ | 0.0469 | 0.0512 | 0.0369 | |
| 8 | 28.691 | 28.966 | 0.275 | 4 |
| 9 | 28.772 | 28.967 | 0.195 | 4 |
| 28 | 28.674 | 28.939 | 0.265 | 4 |
| 29 | 28.597 | 29.006 | 0.409 | 4 |
| 39 | 28.613 | 28.954 | 0.341 | 4 |
| 40 | 28.690 | 28.995 | 0.305 | 4 |
| 50 | 28.675 | 28.958 | 0.283 | 4 |
| 51 | 28.653 | 28.952 | 0.299 | 4 |
| 61 | 28.719 | 28.958 | 0.239 | 4 |
| 62 | 28.737 | 28.954 | 0.217 | 4 |
| AVE | 28.682 | 28.965 | 0.283 | |
| σ | 0.0533 | 0.0205 | 0.0945 | |
| 7 | 28.652 | 28.932 | 0.280 | 5 |
| 16 | 28.694 | 28.959 | 0.265 | 5 |
| 17 | 28.637 | 29.003 | 0.366 | 5 |
| 18 | 28.637 | 28.970 | 0.333 | 5 |
| 37 | 28.664 | 28.891 | 0.227 | 5 |
| 38 | 28.589 | 28.875 | 0.286 | 5 |
| 48 | 28.665 | 29,016 | 0.351 | 5 |
| 49 | 28.686 | 28.917 | 0.231 | 5 |
| 59 | 28.755 | 29.018 | 0.263 | 5 |
| 60 | 28.690 | 28.931 | 0.241 | 5 |
| AVE | 28.667 | 28.951 | 0.284 | |
| σ | 0.0441 | 0.0507 | 0.0742 | |
| 3 | 28.577 | 29.043 | 0.466 | 6 |
| 4 | 28.592 | 28.973 | 0.381 | 6 |
| 14 | 28.715 | 28.872 | 0.157 | 6 |
| 15 | 28.736 | 28.964 | 0.228 | 6 |
| 25 | 28.656 | 28.960 | 0.304 | 6 |
| 26 | 28.666 | 28.966 | 0.300 | 6 |
| 27 | 28.687 | 29.024 | 0.387 | 6 |
| 36 | 28.682 | 28.962 | 0.280 | 6 |
| 46 | 28.631 | 28.883 | 0.252 | 6 |
| 47 | 28.631 | 28.980 | 0.349 | 6 |
| AVE | 28.657 | 28.963 | 0.305 | |
| σ | 0.0508 | 0.0529 | 0.1070 | |

FIG. 28

| No | R SIDE | | | L SIDE | | | RECYCL TIMES |
|---|---|---|---|---|---|---|---|
| | BEFORE | AFTER | 前後差 | BEFORE | AFTER | DIFF | |
| 1 | 14.228 | 14.224 | -0.004 | 14.230 | 14.224 | -0.006 | 1 |
| 2 | 14.220 | 14.208 | -0.012 | 14.227 | 14.217 | -0.010 | 1 |
| 12 | 14.224 | 14.222 | -0.002 | 14.228 | 14.220 | -0.008 | 1 |
| 13 | 14.214 | 14.211 | -0.003 | 14.219 | 14.208 | -0.011 | 1 |
| 23 | 14.221 | 14.214 | -0.007 | 14.235 | 14.226 | -0.009 | 1 |
| 24 | 14.235 | 14.217 | -0.018 | 14.225 | 14.213 | -0.012 | 1 |
| 34 | 14.217 | 14.212 | -0.005 | 14.213 | 14.209 | -0.004 | 1 |
| 35 | 14.209 | 14.203 | -0.006 | 14.209 | 14.193 | -0.016 | 1 |
| 45 | 14.226 | 14.223 | -0.003 | 14.232 | 14.223 | -0.009 | 1 |
| 55 | 14.216 | 14.213 | -0.003 | 14.216 | 14.220 | 0.004 | 1 |
| 56 | 14.231 | 14.214 | -0.017 | 14.202 | 14.205 | 0.003 | 1 |
| AVE | 14.222 | 14.215 | | 14.221 | 14.214 | | |
| σ | 0.0078 | 0.0065 | | 0.0105 | 0.0099 | | |
| 10 | 14.228 | 14.203 | -0.025 | 14.214 | 14.206 | -0.008 | 2 |
| 11 | 14.218 | 14.216 | -0.002 | 14.224 | 14.215 | -0.009 | 2 |
| 21 | 14.219 | 14.221 | 0.002 | 14.226 | 14.236 | 0.010 | 2 |
| 22 | 14.210 | 14.203 | -0.007 | 14.202 | 14.208 | 0.006 | 2 |
| 32 | 14.229 | 14.227 | -0.002 | 14.235 | 14.227 | -0.008 | 2 |
| 33 | 14.231 | 14.224 | -0.007 | 14.231 | 14.219 | -0.012 | 2 |
| 43 | 14.210 | 14.201 | -0.009 | 14.218 | 14.205 | -0.013 | 2 |
| 44 | 14.222 | 14.211 | -0.011 | 14.223 | 14.216 | -0.007 | 2 |
| 54 | 14.224 | 14.225 | 0.001 | 14.227 | 14.216 | -0.011 | 2 |
| 57 | 14.224 | 14.219 | -0.005 | 14.223 | 14.228 | 0.005 | 2 |
| 58 | 14.208 | 14.193 | -0.015 | 14.218 | 14.191 | -0.027 | 2 |
| AVE | 14.220 | 14.213 | -0.007 | 14.222 | 14.215 | -0.007 | |
| σ | 0.0081 | 0.0115 | 0.0078 | 0.0089 | 0.0126 | 0.0104 | |
| 5 | 14.205 | 14.199 | -0.006 | 14.218 | 14.205 | -0.013 | 3 |
| 6 | 14.207 | 14.191 | -0.016 | 14.209 | 14.196 | -0.013 | 3 |
| 19 | 14.228 | 14.211 | -0.017 | 14.226 | 14.217 | -0.009 | 3 |
| 20 | 14.233 | 14.222 | -0.011 | 14.231 | 14.221 | -0.010 | 3 |
| 30 | 14.230 | 14.195 | -0.035 | 14.225 | 14.200 | -0.025 | 3 |
| 31 | 14.199 | 14.208 | 0.009 | 14.192 | 14.203 | 0.011 | 3 |
| 41 | 14.218 | 14.205 | -0.013 | 14.238 | 14.214 | -0.024 | 3 |
| 42 | 14.201 | 14.192 | -0.009 | 14.210 | 14.201 | -0.009 | 3 |
| 52 | 14.228 | 14.217 | -0.011 | 14.235 | 14.218 | -0.017 | 3 |
| 53 | 14.221 | 14.204 | -0.017 | 14.221 | 14.205 | -0.016 | 3 |
| 63 | 14.230 | 14.218 | -0.012 | 14.231 | 14.218 | -0.013 | 3 |
| AVE | 14.218 | 14.206 | -0.013 | 14.221 | 14.209 | -0.013 | |
| σ | 0.0129 | 0.0107 | 0.0104 | 0.0136 | 0.0088 | 0.0095 | |
| 8 | 14.201 | 14.207 | 0.006 | 14.199 | 14.209 | 0.010 | 4 |
| 9 | 14.217 | 14.202 | -0.015 | 14.220 | 14.195 | -0.025 | 4 |
| 28 | 14.224 | 14.221 | -0.003 | 14.231 | 14.225 | -0.006 | 4 |
| 29 | 14.207 | 14.194 | -0.013 | 14.212 | 14.193 | -0.019 | 4 |
| 39 | 14.216 | 14.198 | -0.018 | 14.221 | 14.201 | -0.020 | 4 |
| 40 | 14.211 | 14.194 | -0.017 | 14.216 | 14.194 | -0.022 | 4 |
| 50 | 14.230 | 14.218 | -0.012 | 14.234 | 14.211 | -0.023 | 4 |
| 51 | 14.218 | 14.203 | -0.015 | 14.214 | 14.208 | -0.006 | 4 |
| 61 | 14.201 | 14.205 | 0.004 | 14.205 | 14.206 | 0.001 | 4 |
| 62 | 14.205 | 14.198 | -0.007 | 14.206 | 14.199 | -0.007 | 4 |
| AVE | 14.213 | 14.204 | -0.007 | 14.216 | 14.204 | -0.010 | |
| σ | 0.0097 | 0.0093 | 0.0101 | 0.0112 | 0.0098 | 0.0129 | |
| 7 | 14.214 | 14.187 | -0.027 | 14.213 | 14.188 | -0.025 | 5 |
| 16 | 14.217 | 14.199 | -0.018 | 14.218 | 14.201 | -0.017 | 5 |
| 17 | 14.231 | 14.220 | -0.011 | 14.235 | 14.225 | -0.010 | 5 |
| 18 | 14.197 | 14.157 | -0.040 | 14.194 | 14.154 | -0.040 | 5 |
| 37 | 14.206 | 14.195 | -0.011 | 14.211 | 14.192 | -0.019 | 5 |
| 38 | 14.228 | 14.218 | -0.010 | 14.233 | 14.224 | -0.009 | 5 |
| 48 | 14.204 | 14.193 | -0.011 | 14.213 | 14.195 | -0.018 | 5 |
| 49 | 14.227 | 14.220 | -0.007 | 14.227 | 14.224 | -0.003 | 5 |
| 59 | 14.208 | 14.192 | -0.016 | 14.251 | 14.184 | -0.031 | 5 |
| 60 | 14.216 | 14.202 | -0.014 | 14.219 | 14.203 | -0.016 | 5 |
| AVE | 14.215 | 14.198 | -0.014 | 14.218 | 14.199 | -0.016 | |
| σ | 0.0113 | 0.0190 | 0.0124 | 0.0119 | 0.0221 | 0.0141 | |
| 3 | 14.201 | 14.170 | -0.031 | 14.208 | 14.170 | -0.038 | 6 |
| 4 | 14.207 | 14.182 | -0.025 | 14.223 | 14.186 | -0.037 | 6 |
| 14 | 14.217 | 14.203 | -0.014 | 14.225 | 14.153 | -0.072 | 6 |
| 15 | 14.212 | 14.189 | -0.023 | 14.215 | 14.184 | -0.031 | 6 |
| 25 | 14.219 | 14.157 | -0.062 | 14.222 | 14.154 | -0.068 | 6 |
| 26 | 14.205 | 14.203 | -0.002 | 14.220 | 14.206 | -0.044 | 6 |
| 27 | 14.200 | 14.170 | -0.030 | 14.216 | 14.169 | -0.047 | 6 |
| 36 | 14.208 | 14.189 | -0.019 | 14.216 | 14.182 | -0.034 | 6 |
| 46 | 14.212 | 14.180 | -0.032 | 14.223 | 14.202 | -0.021 | 6 |
| 47 | 14.210 | 14.191 | -0.019 | 14.211 | 14.204 | -0.007 | 6 |
| AVE | 14.209 | 14.183 | -0.022 | 14.218 | 14.181 | -0.032 | |
| σ | 0.0062 | 0.0148 | 0.0188 | 0.0056 | 0.0195 | 0.0253 | |

FIG. 30

| No | BEFORE TEST | AFTER TEST | DIFFERENCE |
|---|---|---|---|
| 64 | 28.691 | 28.829 | 0.138 |
| 65 | 28.772 | 28.822 | 0.050 |
| 66 | 28.573 | 28.863 | 0.290 |
| 67 | 28.688 | 28.879 | 0.191 |
| 68 | 28.718 | 28.937 | 0.219 |
| 69 | 28.706 | 28.918 | 0.212 |
| 70 | 28.703 | 28.911 | 0.208 |
| 71 | 28.625 | 28.828 | 0.203 |
| 72 | 28.729 | 28.886 | 0.157 |
| 73 | 28.642 | 28.827 | 0.185 |
| 74 | 28.701 | 28.902 | 0.201 |
| 75 | 28.722 | 28.921 | 0.199 |
| 76 | 28.717 | 28.887 | 0.170 |
| 77 | 28.631 | 28.925 | 0.294 |
| 78 | 28.665 | 28.838 | 0.173 |
| 79 | 28.686 | 28.871 | 0.185 |
| 80 | 28.690 | 28.872 | 0.182 |
| 81 | 28.691 | 28.848 | 0.157 |
| 82 | 28.681 | 28.832 | 0.151 |
| 83 | 28.661 | 28.926 | 0.265 |
| 84 | 28.712 | 28.903 | 0.191 |
| 85 | 28.625 | 28.893 | 0.268 |
| 86 | 28.703 | 28.874 | 0.171 |
| 87 | 28.621 | 28.896 | 0.275 |
| 88 | 28.722 | 28.817 | 0.095 |
| 89 | 28.717 | 28.901 | 0.184 |
| 90 | 28.610 | 28.858 | 0.248 |
| 91 | 28.682 | 28.850 | 0.168 |
| 92 | 28.664 | 28.850 | 0.186 |
| 93 | 28.690 | 28.880 | 0.190 |
| 94 | 28.719 | 28.877 | 0.158 |
| 95 | 28.737 | 28.865 | 0.128 |
| 96 | 28.622 | 28.816 | 0.194 |
| 97 | 28.652 | 28.848 | 0.196 |
| 98 | 28.652 | 28.838 | 0.186 |
| 99 | 28.625 | 28.890 | 0.265 |
| 100 | 28.703 | 28.859 | 0.156 |
| 101 | 28.621 | 28.889 | 0.268 |
| 102 | 28.692 | 28.868 | 0.176 |
| 103 | 28.630 | 28.888 | 0.258 |
| 104 | 28.592 | 28.827 | 0.235 |
| 105 | 28.622 | 28.812 | 0.190 |
| 106 | 28.703 | 28.884 | 0.181 |
| 107 | 28.621 | 28.877 | 0.256 |
| 108 | 28.656 | 28.850 | 0.194 |
| 109 | 28.666 | 28.903 | 0.237 |
| 110 | 28.653 | 28.817 | 0.164 |
| 111 | 28.690 | 28.838 | 0.148 |
| 112 | 28.691 | 28.874 | 0.183 |
| 113 | 28.681 | 28.872 | 0.191 |
| 114 | 28.573 | 28.854 | 0.281 |
| 115 | 28.688 | 28.834 | 0.146 |
| 116 | 28.718 | 28.893 | 0.175 |
| 117 | 28.685 | 28.866 | 0.181 |
| 118 | 28.577 | 28.872 | 0.295 |
| 119 | 28.592 | 28.895 | 0.303 |
| 120 | 28.622 | 28.859 | 0.237 |
| 121 | 28.703 | 28.883 | 0.180 |
| 122 | 28.625 | 28.893 | 0.268 |
| 123 | 28.703 | 28.859 | 0.156 |
| 124 | 28.656 | 28.934 | 0.278 |
| 125 | 28.666 | 28.892 | 0.226 |
| 126 | 28.687 | 28.927 | 0.240 |
| AVE | 28.669 | 28.871 | 0.202 |
| $\sigma$ | 0.0442 | 0.0323 | 0.0511 |

FIG. 31

| No | R SIDE | | | L SIDE | | |
|---|---|---|---|---|---|---|
| | BEFORE | AFTER | DIFF | BEFORE | AFTER | DIFF |
| 64 | 14.217 | 14.212 | -0.005 | 14.125 | 14.220 | 0.005 |
| 65 | 14.235 | 14.229 | -0.006 | 14.238 | 14.230 | -0.008 |
| 66 | 14.224 | 14.220 | -0.004 | 14.220 | 14.228 | 0.008 |
| 67 | 14.212 | 14.217 | 0.005 | 14.220 | 14.213 | -0.007 |
| 68 | 14.240 | 14.220 | -0.020 | 14.240 | 14.223 | -0.017 |
| 69 | 14.215 | 14.213 | -0.002 | 14.213 | 14.212 | -0.001 |
| 70 | 14.211 | 14.214 | 0.003 | 14.213 | 14.223 | 0.010 |
| 71 | 14.217 | 14.220 | 0.003 | 14.221 | 14.213 | -0.008 |
| 72 | 14.215 | 14.213 | -0.002 | 14.215 | 14.215 | 0.000 |
| 73 | 14.211 | 14.207 | -0.004 | 14.214 | 14.208 | -0.006 |
| 74 | 14.220 | 14.221 | 0.001 | 14.211 | 14.228 | 0.012 |
| 75 | 14.182 | 14.198 | 0.011 | 14.233 | 14.227 | -0.006 |
| 76 | 14.230 | 14.228 | -0.002 | 14.225 | 14.232 | 0.007 |
| 77 | 14.225 | 14.216 | -0.009 | 14.227 | 14.220 | 0.007 |
| 78 | 14.208 | 14.211 | 0.003 | 14.215 | 14.214 | -0.001 |
| 79 | 14.227 | 14.220 | -0.007 | 14.228 | 14.216 | -0.012 |
| 80 | 14.193 | 14.198 | 0.005 | 14.194 | 14.199 | 0.005 |
| 81 | 14.217 | 14.212 | -0.005 | 14.215 | 14.215 | 0.000 |
| 82 | 14.214 | 14.218 | 0.004 | 14.235 | 14.219 | -0.016 |
| 83 | 14.205 | 14.200 | -0.005 | 14.208 | 14.201 | -0.007 |
| 84 | 14.234 | 14.231 | -0.003 | 14.233 | 14.225 | -0.008 |
| 85 | 14.226 | 14.219 | -0.007 | 14.225 | 14.218 | -0.007 |
| 86 | 14.238 | 14.226 | -0.012 | 14.232 | 14.227 | -0.005 |
| 87 | 14.207 | 14.206 | -0.001 | 14.207 | 14.209 | 0.002 |
| 88 | 14.221 | 14.224 | 0.003 | 14.217 | 14.218 | 0.001 |
| 89 | 14.209 | 14.221 | 0.012 | 14.231 | 14.280 | -0.001 |
| 90 | 14.212 | 14.214 | 0.002 | 14.216 | 14.219 | 0.003 |
| 91 | 14.207 | 14.201 | -0.006 | 14.211 | 14.204 | -0.007 |
| 92 | 14.220 | 14.226 | 0.006 | 14.229 | 14.229 | 0.000 |
| 93 | 14.211 | 14.207 | -0.004 | 14.215 | 14.211 | -0.004 |
| 94 | 14.232 | 14.233 | 0.001 | 14.231 | 14.229 | -0.002 |
| 95 | 14.213 | 14.199 | -0.014 | 14.221 | 14.205 | -0.016 |
| 96 | 14.215 | 14.196 | -0.019 | 14.207 | 14.205 | -0.002 |
| 97 | 14.243 | 14.233 | -0.010 | 14.241 | 14.205 | -0.006 |
| 98 | 14.217 | 14.219 | 0.002 | 14.227 | 14.235 | -0.002 |
| 99 | 14.222 | 14.214 | -0.008 | 14.227 | 14.225 | -0.009 |
| 100 | 14.230 | 14.225 | -0.005 | 14.230 | 14.223 | -0.007 |
| 101 | 14.221 | 14.219 | -0.002 | 14.213 | 14.219 | 0.006 |
| 102 | 14.215 | 14.212 | -0.003 | 14.216 | 14.213 | -0.003 |
| 103 | 14.230 | 14.233 | 0.003 | 14.226 | 14.229 | 0.003 |
| 104 | 14.211 | 14.206 | -0.005 | 14.216 | 14.213 | -0.003 |
| 105 | 14.221 | 14.212 | -0.009 | 14.226 | 14.221 | -0.005 |
| 106 | 14.199 | 14.198 | -0.001 | 14.204 | 14.201 | -0.003 |
| 107 | 14.230 | 14.233 | 0.003 | 14.231 | 14.231 | 0.000 |
| 108 | 14.212 | 14.207 | -0.005 | 14.212 | 14.209 | -0.003 |
| 109 | 14.211 | 14.207 | -0.004 | 14.215 | 14.210 | -0.005 |
| 110 | 14.220 | 14.218 | -0.002 | 14.225 | 14.221 | -0.004 |
| 111 | 14.208 | 14.207 | -0.001 | 14.216 | 14.211 | -0.005 |
| 112 | 14.219 | 14.225 | 0.006 | 14.229 | 14.234 | 0.005 |
| 113 | 14.230 | 14.224 | -0.006 | 14.229 | 14.231 | 0.002 |
| 114 | 14.227 | 14.202 | 0.005 | 14.222 | 14.225 | 0.003 |
| 115 | 14.232 | 14.224 | -0.008 | 14.235 | 14.223 | -0.012 |
| 116 | 14.210 | 14.202 | -0.008 | 14.213 | 14.206 | -0.007 |
| 117 | 14.230 | 14.222 | -0.008 | 14.223 | 14.219 | -0.004 |
| 118 | 14.215 | 14.199 | -0.016 | 14.225 | 14.206 | -0.019 |
| 119 | 14.223 | 14.255 | 0.002 | 14.224 | 14.226 | 0.002 |
| 120 | 14.220 | 14.221 | 0.001 | 14.221 | 14.225 | 0.004 |
| 121 | 14.228 | 14.221 | -0.007 | 14.232 | 14.222 | -0.010 |
| 122 | 14.217 | 14.226 | 0.009 | 14.229 | 14.231 | 0.002 |
| 123 | 14.221 | 14.228 | 0.007 | 14.229 | 14.232 | 0.003 |
| 124 | 14.228 | 14.231 | 0.003 | 14.227 | 14.227 | 0.000 |
| 125 | 14.223 | 14.217 | -0.006 | 14.214 | 14.217 | 0.003 |
| 126 | 14.220 | 14.220 | 0.000 | 14.213 | 14.212 | -0.001 |
| AVE | 14.219 | 14.217 | -0.002 | 14.222 | 14.219 | -0.003 |
| $\sigma$ | 0.0109 | 0.0105 | 0.0066 | 0.0095 | 0.0092 | 0.0064 |

(A)

MEASUREMENT RESULT

| FREQUENCY (HZ) | SOUND PRESSURE LEVEL OF EACH MICROPHONE | | | | | |
|---|---|---|---|---|---|---|
| | NEW (N) | 62(N) | 67(N) | 34(R) | FLAW①(R) | FLAW②(R) |
| 100 | 26.58 | 28.68 | 29.48 | 28.78 | 29.24 | 31.18 |
| 125 | 26.34 | 25.88 | 26.83 | 27.18 | 27.07 | 28.58 |
| 160 | 32.21 | 29.65 | 30.07 | 29.98 | 32.46 | 30.57 |
| 200 | 34.38 | 33.69 | 33.62 | 35.37 | 35.87 | 34.58 |
| 250 | 35.42 | 34.55 | 34.50 | 35.71 | 34.79 | 35.58 |
| 315 | 37.07 | 37.08 | 36.93 | 37.09 | 37.23 | 37.35 |
| 400 | 36.65 | 36.73 | 36.62 | 36.25 | 36.35 | 36.07 |
| 500 | 33.80 | 33.00 | 33.82 | 33.60 | 33.40 | 33.44 |
| 630 | 33.62 | 33.85 | 33.93 | 34.38 | 34.05 | 34.05 |
| 800 | 31.99 | 32.23 | 32.29 | 32.16 | 32.34 | 32.53 |
| 1000 | 36.27 | 38.99 | 43.65 | 42.98 | 36.39 | 36.71 |
| 1250 | 37.06 | 34.25 | 33.40 | 32.68 | 35.80 | 36.13 |
| 1600 | 31.49 | 31.09 | 30.85 | 30.86 | 31.10 | 31.36 |
| 2000 | 36.41 | 30.68 | 31.56 | 30.89 | 36.71 | 37.82 |
| 2500 | 26.32 | 25.41 | 25.64 | 25.71 | 26.51 | 26.49 |
| 3150 | 24.68 | 24.41 | 27.06 | 26.83 | 24.59 | 24.22 |
| 4000 | 24.64 | 22.95 | 23.65 | 23.55 | 24.93 | 24.08 |
| 5000 | 18.79 | 17.86 | 18.64 | 18.50 | 18.97 | 17.80 |
| 6300 | 17.08 | 16.49 | 17.12 | 16.96 | 17.15 | 16.67 |
| 8000 | 13.67 | 12.93 | 13.22 | 14.25 | 13.95 | 13.01 |
| 10000 | 12.01 | 10.87 | 12.33 | 11.92 | 12.47 | 10.94 |

FIG. 33

| ITEM | STANDARD VALUE | | NEW PRODUCT | | RECOVERED PRODUCT | | RECYCLED PRODUCT | | INITIAL DISPLACEMENT | | EVALUATION |
|---|---|---|---|---|---|---|---|---|---|---|---|
| | | | VALUE | n | VALUE | n | VALUE | n | VALUE | n | |
| • EXPANSION WIDTH OF SLIT | 2.6~3.5 | X<br>σ<br>CPK | 2.94<br>0.099<br>1.145 | 40 | 2.21<br>0.210<br>— | 123 | 3.03<br>0.206<br>0.697 | 123 | GO/NOGO EXAMINATION (TOTAL ACCEPTANCE) | 140K | ○ |
| • OUTER DIAMETER (RADIUS) | 14.187~14.237 | X<br>σ<br>CPK | 14.209<br>0.0030<br>2.444 | 40 | 14.205<br>0.0141<br>— | 123 | 14.196<br>0.0174<br>0.172 | 123 | — | | × |
| •RADIAL THICKNESS | 3.8~4.5 | X<br>σ | 4.2109<br>0.0416 | 30 | — | | 4.2426<br>0.0992 | 30 | — | | ○ |
| • HINGE THICKNESS | 0.6~0.8 | X<br>σ | 0.7112<br>0.0199 | 30 | — | | 0.760<br>0.0858 | 30 | — | | ○ |
| • STRAIGHTNESS | ≦0.11 | X<br>σ | 0.0350<br>0.0148 | 30 | — | | 0.0446<br>0.0164 | 30 | — | | ○ |
| • TOTAL LENGTH | 90~105 | X<br>σ | 99.616<br>0.0125 | 40 | 99.617<br>0.0169 | 30 | 99.614<br>0.0149 | 30 | — | | ○ |
| • DISCHARGE SOUND | — | | | 1 | EQUIVALENT OF NEW PRODUCT | 1 | EQUIVALENT OF NEW PRODUCT | 5 | EQUIVALENT OF NEW PRODUCT | | ○ |
| •OUTER APPEARANCE | NO FLAW/BURR/ CHIP-ATTACHMENT | X<br>σ | SATIS FACTORY | 40 | — | | SATISFACTORY (BOUNDARY SAMPLE) | 30 | | | ○ |

(A)

| | 50℃ | 65℃ | 80℃ |
|---|---|---|---|
| 5MIN | ① | ④ | ⑦ |
| 10MIN | ② | ⑤ | ⑧ |
| 20MIN | ③ | ⑥ | ⑨ |

FIG. 40

PHYSICAL PROPERTIES OF NEW-PRODUCT ABS SILENCER

| | MAXIMUM OUTER DIAMETER | RADIUS | |
|---|---|---|---|
| | | R SIDE | L SIDE |
| 1 | 28.824 | 14.221 | 14.224 |
| 2 | 28.828 | 14.227 | 14.287 |
| 3 | 28.826 | 14.219 | 14.222 |
| 4 | 28.816 | 14.223 | 14.220 |
| 5 | 28.822 | 14.223 | 14.222 |
| 6 | 28.824 | 14.229 | 14.219 |
| 7 | 28.822 | 14.219 | 14.226 |
| 8 | 28.889 | 14.219 | 14.222 |
| 9 | 28.808 | 14.227 | 14.223 |
| 10 | 28.829 | 14.222 | 14.225 |
| 11 | 28.804 | 14.226 | 14.231 |
| 12 | 28.840 | 14.224 | 14.220 |
| 13 | 28.808 | 14.226 | 14.227 |
| 14 | 28.824 | 14.225 | 14.223 |
| 15 | 28.799 | 14.218 | 14.233 |
| 16 | 28.818 | 14.224 | 14.228 |
| 17 | 28.809 | 14.216 | 14.221 |
| 18 | 28.840 | 14.221 | 14.219 |
| 19 | 28.818 | 14.222 | 14.221 |
| 20 | 28.841 | 14.210 | 14.219 |
| 21 | 28.823 | 14.225 | 14.230 |
| 22 | 28.816 | 14.231 | 14.226 |
| 23 | 28.806 | 14.221 | 14.226 |
| 24 | 28.831 | 14.230 | 14.229 |
| 25 | 28.812 | 14.225 | 14.229 |
| 26 | 28.828 | 14.222 | 14.228 |
| 27 | 28.828 | 14.224 | 14.223 |
| 28 | 28.828 | 14.228 | 14.226 |
| 29 | 28.811 | 14.227 | 14.228 |
| 30 | 28.817 | 14.229 | 14.230 |
| AVERAGE | 28.821 | 14.223 | 14.227 |
| $\sigma$ | 0.0112 | 0.0045 | 0.0120 |

| NO | 11/4 | 11/5 | 11/6 | 11/7 | 11/10 | 11/11 | 11/12 | 11/13 | 11/14 | 11/17 | |
|---|---|---|---|---|---|---|---|---|---|---|---|
| 1 | 2.82 | 3.05 | 2.97 | 3.03 | 3.12 | 3.19 | 3.20 | 2.86 | 3.00 | 2.95 | |
| 2 | 2.70 | 2.70 | 3.01 | 2.73 | 2.91 | 2.90 | 3.18 | 3.06 | 2.94 | 3.05 | |
| 3 | 3.01 | 3.04 | 2.83 | 2.97 | 3.02 | 3.05 | 3.03 | 3.17 | 3.10 | 3.15 | |
| 4 | 3.03 | 3.14 | 3.02 | 2.84 | 3.00 | 2.83 | 3.14 | 3.02 | 3.26 | 2.90 | |
| 5 | 2.95 | 3.05 | 2.95 | 2.85 | 2.94 | 3.00 | 3.00 | 3.23 | 3.12 | 2.93 | |
| 6 | 2.97 | 3.10 | 2.91 | 2.98 | 3.02 | 2.90 | 2.97 | 3.03 | 3.09 | 2.98 | |
| 7 | 3.04 | 3.05 | 3.05 | 2.90 | 2.93 | 2.97 | 3.17 | 3.06 | 3.31 | 3.07 | |
| 8 | 2.90 | 3.02 | 2.91 | 2.96 | 2.90 | 3.03 | 3.11 | 3.12 | 3.20 | 3.20 | |
| 9 | 2.84 | 3.06 | 2.97 | 3.15 | 3.00 | 3.05 | 2.86 | 3.23 | 3.11 | 3.11 | |
| 10 | 2.86 | 2.90 | 3.04 | 2.96 | 3.17 | 3.06 | 2.94 | 2.88 | 3.07 | 2.96 | |
| 11 | 2.89 | 3.07 | 2.86 | 3.21 | 3.18 | 2.96 | 3.04 | 2.78 | 3.08 | 3.19 | |
| 12 | 3.16 | 3.05 | 3.11 | 3.09 | 3.05 | 3.21 | 3.18 | 3.01 | 3.08 | 3.30 | |
| 13 | 3.18 | 3.12 | 2.86 | 3.37 | 3.17 | 3.00 | 3.15 | 2.99 | 3.10 | 3.24 | |
| 14 | 3.07 | 3.06 | 3.37 | 3.00 | 3.30 | 2.94 | 2.99 | 3.01 | 3.32 | 3.05 | |
| 15 | 3.27 | 2.97 | 3.26 | 3.02 | 3.13 | 3.05 | 2.91 | 3.24 | 3.30 | 2.97 | |
| 16 | 2.95 | 3.23 | 2.98 | 3.04 | 3.12 | 3.03 | 3.02 | 3.13 | 2.85 | 2.98 | |
| 17 | 3.01 | 3.19 | 2.86 | 3.03 | 3.25 | 2.88 | 3.04 | 2.87 | 2.97 | 3.00 | |
| 18 | 2.84 | 3.10 | 3.08 | 3.11 | 3.04 | 3.19 | 3.08 | 3.01 | 3.04 | 2.92 | |
| 19 | 2.73 | 3.00 | 3.08 | 3.07 | 3.08 | 2.88 | 2.81 | 2.96 | 3.17 | 3.01 | |
| 20 | 2.86 | 3.05 | 2.89 | 3.01 | 3.23 | 3.00 | 2.84 | 2.90 | 3.02 | 3.05 | |
| 21 | 2.98 | 3.15 | 2.99 | 3.17 | 3.09 | 3.07 | 2.95 | 2.85 | 3.00 | 2.90 | |
| 22 | 2.80 | 3.02 | 3.12 | 3.26 | 3.18 | 3.14 | 3.12 | 2.98 | 3.15 | 3.09 | |
| 23 | 2.90 | 3.14 | 2.90 | 2.93 | 3.12 | 2.80 | 3.18 | 3.14 | 3.27 | 3.18 | |
| 24 | 3.09 | 2.75 | 3.41 | 3.09 | 3.10 | 2.91 | 3.01 | 2.95 | 3.00 | 3.16 | |
| 25 | 2.70 | 3.01 | 3.02 | 2.87 | 3.08 | 3.02 | 3.06 | 2.91 | 2.86 | 2.87 | |
| 26 | 3.01 | 3.02 | 3.14 | 2.93 | 2.97 | 3.26 | 2.89 | 3.19 | 3.10 | 3.12 | |
| 27 | 3.21 | 3.04 | 2.99 | 2.95 | 3.06 | 2.79 | 2.97 | 2.93 | 2.90 | 3.22 | |
| 28 | 2.91 | 3.24 | 3.27 | 3.16 | 3.21 | 3.08 | 3.25 | 3.03 | 3.21 | 3.02 | |
| 29 | 2.99 | 2.83 | 3.07 | 2.97 | 2.99 | 2.90 | 3.22 | 3.10 | 3.24 | 2.88 | |
| 30 | 3.15 | 3.02 | 3.29 | 2.95 | 2.97 | 3.04 | 3.05 | 3.09 | 2.98 | 2.90 | N=300 |
| AVE | 2.9607 | 3.039 | 3.0403 | 3.020 | 3.0777 | 3.0043 | 3.0453 | 3.0243 | 3.0947 | 3.0450 | 3.03513 |
| σ | 0.1473 | 0.1202 | 0.1532 | 0.1338 | 0.1049 | 0.1196 | 0.119 | 0.123 | 0.1306 | 0.120 | 0.13081 |
| CPK | | | | | | | | | | | 1.109 |

| SECTION | FREQUENCY |
|---|---|
| 2.50 | 0 |
| 2.60 | 0 |
| 2.70 | 3 |
| 2.80 | 7 |
| 2.90 | 44 |
| 3.00 | 68 |
| 3.10 | 93 |
| 3.20 | 52 |
| 3.30 | 28 |
| 3.40 | 4 |
| 3.50 | 1 |
| 3.60 | 0 |

FIG. 43
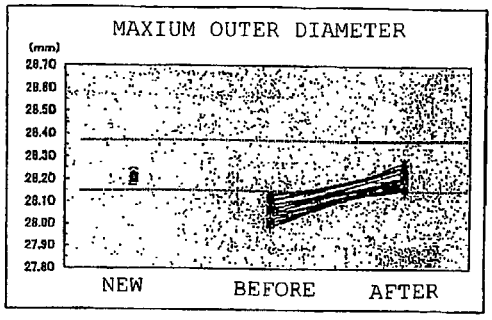
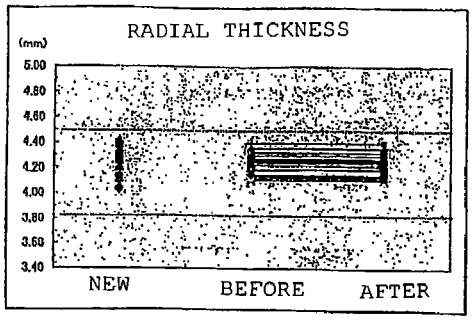
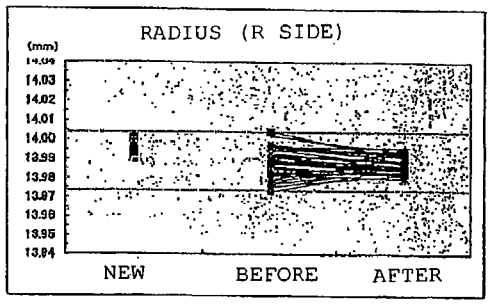
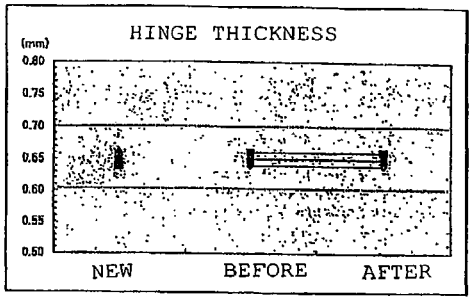
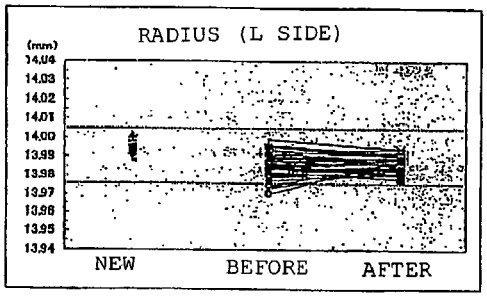
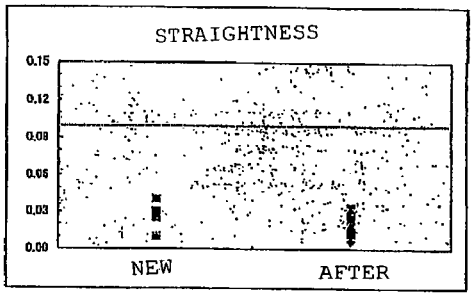
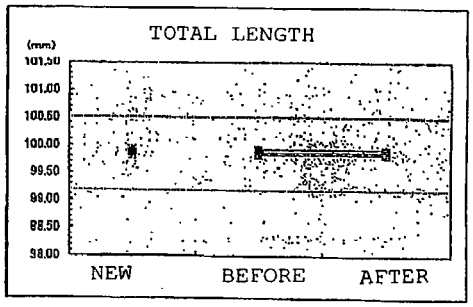
TEST CONDITIONS
PREHEATING
ANNEALING
DRYING; AIR BLOW: 3 MINUTES + ELECTRIC FAN: 10 MINUTES
N NUMBER:63 PIECES

RECYCLING METHOD AND RECYCLING APPARATUS OF PART FOR IMAGE FORMING APPARATUS, AND RECYCLED PART FOR IMAGE FORMING APPARATUS

FIELD OF THE INVENTION AND RELATED ART STATEMENT

The present invention relates to a recycling method and recycling apparatus of a part for an image forming apparatus which are used for an image forming apparatus, which employs an electrophotographic system, such as a copying machine, a printer, or a facsimile, and to a recycled part for an image forming apparatus. The present invention particularly relates to a recycling method and recycling apparatus of a part for an image forming apparatus which can regain original dimensions and the like through heat processing in the case where a part such as a sound deadening member, which is formed of thermoplastic resin and is used in the image forming apparatus, is changed in dimensions and the like after being used and to a recycled part for an image forming apparatus.

In recent years, as to the above-described image forming apparatus, which employs an electrophotographic system, such as a copying machine, a printer, or a facsimile, the age of mass production/mass disposal has rapidly shifted to the age of resource saving/environment regeneration. The applicants of the present invention have constructed an original resource environment type production system that brings into view the entirety of a product life cycle that includes from product planning/development/manufacturing to disposal forerunning other companies in the industry in order to provide users with products with less environment load. The original resource environment type production system is provided with an original recovery system, and the original recovery system is effectively utilized as a recycle route. With the resource environment type production system, a used product such as copying machine or printer is recovered as resource, parts of the product are again put in a unified production line that is directly connected with assembly to be circulated as parts or materials.

Up to now, the resource environment type production system is structured such that: a used product such as copying machine or printer is recovered as resource from a market; the product such as copying machine or printer is disassembled to retrieve individual parts; and the parts are subjected to sorting/examination etc. to be circulated as parts or the like again. In this case, with the above-described resource environment type production system, the used parts are examined for the dimensions or the like to know whether the parts can be reused, and only acceptable parts are reused.

An example of the part for an image forming apparatus which is reused in the resource environment type production system is a sound deadening member for an electrophotographic photosensitive body disclosed in JP 2001-13704 A.

The sound deadening member for an electrophotographic photosensitive body, which is disclosed in JP 2001-13704 A, is a cylindrical member made of thermoplastic resin which is anchored to the inner circumference of a photosensitive drum. The sound deadening member for an electrophotographic photosensitive body is for preventing occurrence of noise due to application of an alternating voltage to a charging roll in performing uniform charging to a surface of the photosensitive drum by means of the charging roll. The sound deadening member is provided with a cut portion with a thickness of 0.5 mm or more at a location in the cylindrical section and is provided with a hinge portion with a thickness equal to or less than half a general thickness. When the sound deadening member is provided to the inner circumferential surface of the photosensitive drum, a portion with a general thickness is formed along an outer diameter so as to be in close contact with the inner circumference of the photosensitive drum. This is because the sound deadening member is easily inserted into or detached from the inner circumference of the photosensitive drum and at the same time, the sound deadening member is anchored to the photosensitive drum in a close contact manner.

However, the above prior art has the following problem. That is, with the resource environment type production system, while a sound deadening member for an electrophotographic photosensitive body which is made of thermoplastic resin is used, the sound deadening member is deformed. Thus, when the used sound-deadening member for an electrophotographic photosensitive body is recovered to be subjected to examination for dimensions or the like as to whether the used member can be reused, the member is judged to be rejected in many cases in the case of, for example, the sound deadening member for an electrophotographic photosensitive body with large deformation. As a result, the recovered part cannot be reused effectively.

In particular, for example, the sound deadening member for an electrophotographic photosensitive body, which is disclosed in JP 2001-13704 A, has a problem in that the member is difficult to be reused since the outer diameter of the member is reduced after being used, and also, since the width of the cut portion is reduced, as a result of which a recycling rate cannot be raised.

OBJECT AND SUMMARY OF INVENTION

The present invention has been made in view of the above circumstances and provides a recycling method and a recycling apparatus of a part for an image forming apparatus, with which the part for the image forming apparatus can be restored with original dimensions and the like by performing heat processing to a deformed part in order to improve a recycling rate of a used part made of thermoplastic resin, and a recycled part for an image forming apparatus.

In order to achieve the above, the recycling method of a part for an image forming apparatus according to the present invention is a recycling method of a part for an image forming apparatus, the part being used in the image forming apparatus and provided with a thermoplastic resin member at least in a part thereof, the recycling method being characterized by including: recovering the part for the image forming apparatus; disassembling the recovered part for the image forming apparatus; retrieving the thermoplastic resin member from the disassembled part for the image forming apparatus; and performing heat processing to the retrieved thermoplastic resin member to recycle the member.

Further, the recycling apparatus of apart for an image forming apparatus according to the present invention is a recycling apparatus of a part for an image forming apparatus, the part being used in the image forming apparatus and provided with a thermoplastic resin member at least in a part thereof, the recycling apparatus being characterized by including a heat processing part that performs heat processing to the recovered thermoplastic resin member to recycle the member.

Further, the recycled part for an image forming apparatus according to the present invention is a recycled part for an image forming apparatus, the part being used in the image forming apparatus and provided with a thermoplastic resin member at least in a part thereof, the recycled part being characterized in that after being recovered, the thermoplastic resin member is subjected to heat processing to be recycled.

According to the present invention, the thermoplastic resin member is preferably applied to, for example, a sound deadening member that is held in a photosensitive drum, as described below. However, the present invention is not limited to this. The part for an image forming apparatus which is recycled and reused according to the present invention may be applied to a cover for an image forming apparatus or a toner container that holds therein a toner.

Further, heat processing to the thermoplastic resin member is generally performed to the whole thermoplastic resin member. However, the heat processing to the thermoplastic resin member may be performed to only a part of the thermoplastic resin member depending on the circumstances.

As described above, according the present invention, there are provided the recycling method and the recycling apparatus of a part for an image forming apparatus, with which the part for the image forming apparatus can be restored to have original dimensions and the like by performing heat processing to a deformed part in order to improve a recycling rate of a used part made of thermoplastic resin, and the recycled part for an image forming apparatus. Accordingly, there are obtained the effects: that a yield rate of part-reuse for market recovered-parts can be improved; that cost of part recycling is reduced; and that a disposal amount of recovered products is reduced and other effects.

BRIEF DESCRIPTION OF THE DRAWINGS

A preferred embodiment of the present invention will be described in detail based on the following figures, wherein:

FIGS. 10A to 10C are structural views of a sound deadening member for an electrophotographic photosensitive body;

FIGS. 11A and 11B are structural views of another example of a sound deadening member for an electrophotographic photosensitive body;

FIGS. 13A and 13B are structural views of a device used in a retrieving step;

FIGS. 21A to 21C are structural views of a constant temperature bath used in the preheating step and the heat-processing step;

FIGS. 26A and 26B are graphs showing results of Experimental Example 1;

FIG. 27 is a chart showing data as grounds for Experimental Example 1;

FIG. 28 is a chart showing data as grounds for Experimental Example 1;

FIG. 30 is a chart showing experimental results;

FIG. 31 is a chart showing experimental results;

FIG. 33 is a graph showing results of Experimental Example 4;

FIG. 40 is a chart showing measurement examples;

FIG. 43 is a graph showing measurement examples.

DETAILED DESCRIPTION OF THE PREFERRED EMBODIMENTS

Hereinafter, embodiments of the present invention will be described with reference to the accompanying drawings.

Embodiment 1

Figure 3:
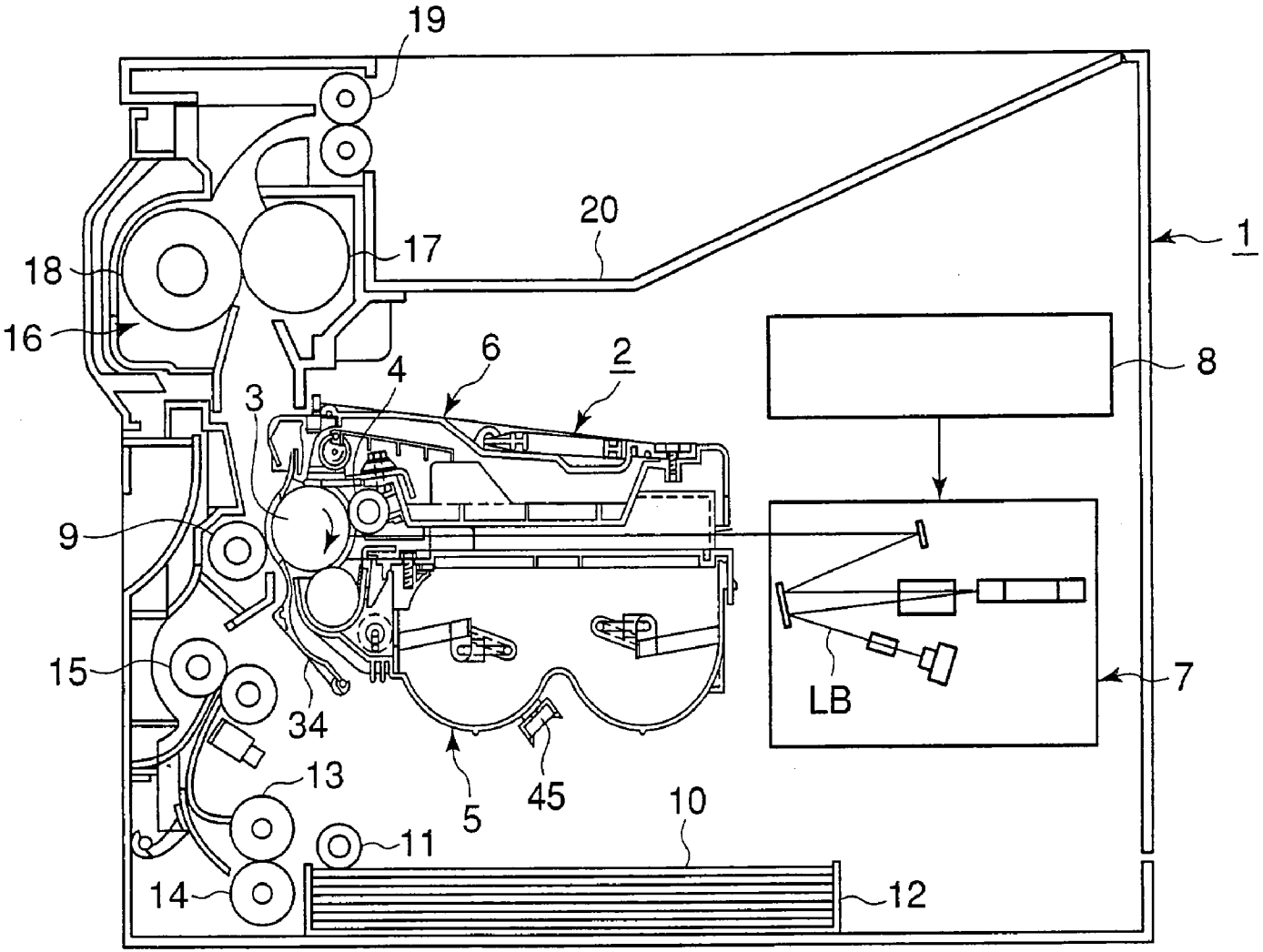
FIG. 3 is a structural view of a digital printer as an image forming apparatus.

FIG. 3 illustrates a digital printer as an image forming apparatus to which a recycling method and a recycling apparatus of a part for an image forming apparatus and a recycled part for an image forming apparatus in accordance with Embodiment 1 of the present invention are applied.

The digital printer is structured to form an image in accordance with image information transmitted from a not-shown personal computer, image reading device, or the like.

Arranged inside a main body 1 of the digital printer is a process cartridge 2 that is integrally unitized with image forming members such as a photosensitive drum. The process cartridge 2 is detachable to the printer main body 1. In the case where the photosensitive drum or the like provided in the process cartridge 2 comes to the end of the lifetime, a cover provided at an upper portion or the like of the printer main body 1 is opened, and the process cartridge 2 can be interchanged with a new process cartridge 2.

Figure 4:
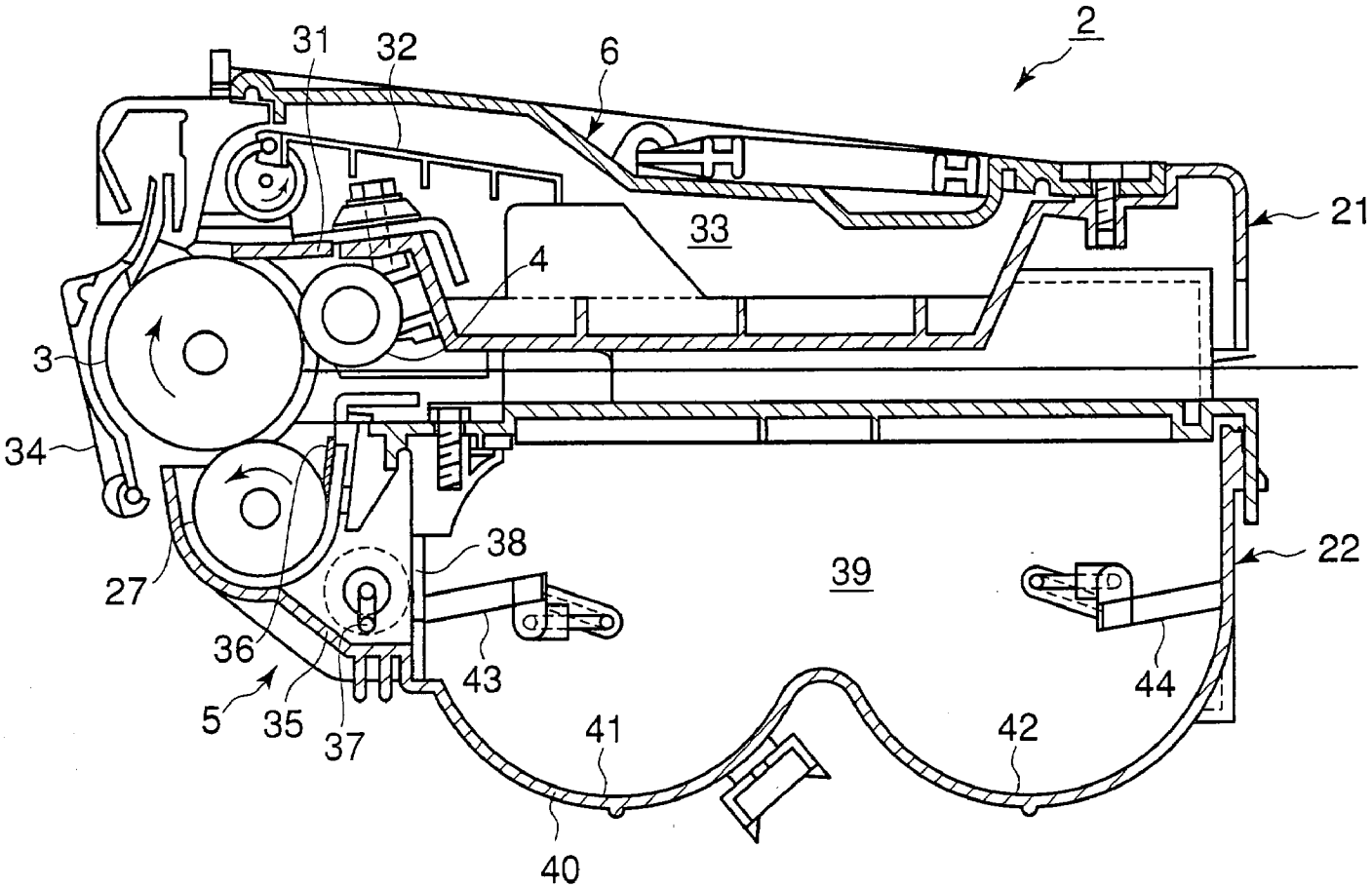
FIG. 4 is a sectional view of a process cartridge as a recycled part for an image forming apparatus.

The process cartridge 2 is structured to be provided with a photosensitive drum 3 as an image bearing body, a charging roll 4 as a charging part, a developing device 5 as a developing part, and a cleaning device 6 as shown in FIGS. 3 and 4.

As the photosensitive drum 3, there is used one, for example, the surface of which is covered with an organic photoconductor (OPC). The photosensitive drum 3 is driven at a predetermined rotational speed in an arrow direction by means of a not-shown driving part. The surface of the photosensitive drum 3 is uniformly charged at a predetermined potential by the charging roll 4 as shown in FIG. 4. Thereafter, image exposure is performed to the surface of the photosensitive drum 3 by a ROS (raster output scanner) 7 as an exposing part (refer to FIG. 3) so that an electrostatic latent image corresponding to image information is formed on the surface. As shown in FIG. 3, the ROS 7 modulates a semiconductor laser in accordance with the image information that has undergone predetermined image processing with an image processing device 8. A laser beam LB emitted from the semiconductor laser is scanned and exposed onto the photosensitive drum 3 through an imaging optical system constituted by a collimator lens, a reflecting mirror, a polygon mirror, an f-θ lens, and the like. As a result, the electrostatic latent image is formed on the surface of the photosensitive drum 3. The electrostatic latent image formed on the photosensitive drum 3 is developed by the developing device 5 that contains a one-component developer (toner) to become a toner image. Note that the developing device 5 may be used with a two-component developer, of course.

The toner image formed on the photosensitive drum 3 is transferred onto a recording sheet 10 as a recording medium by a transfer roll 9 as a transfer part as shown in FIG. 3. The recording sheet 10 is fed from a sheet feeding cassette 12 by means of a feed roll 11. Thereafter, the recording sheet 10 as a sheet separated by a separation roll 13 and a retard roll 14 is conveyed to a registration roll 15, and is stopped once. Then, the recording sheet 10 is conveyed to the surface of the photosensitive drum 3 in synchronization with the toner image formed on the photosensitive drum 3 by means of the registration roll 15. The toner image is transferred onto the recording sheet 10 from the photosensitive drum 3 by means of the transfer roll 9.

The recording sheet 10 on which the toner image is transferred is separated from the photosensitive drum 3, and then is conveyed to a fixing device 16. The recording sheet 10 is fixed with heat and pressure by means of a heating roll 17 and a pressure roll 18 in the fixing device 16. Thereafter, the recording sheet 10 is discharged onto a sheet discharging tray 20 provided in the upper portion of the printer main body 1 by means of a discharge roll 19. Thus, a series of an image forming process is completed.

Incidentally, a residual toner on the surface of the photosensitive drum 3 is removed by the cleaning device 6 after the completion of the transfer step of the toner image, and the next image forming process is waited.

FIG. 4 illustrates the process cartridge of the digital printer.

Figure 5:
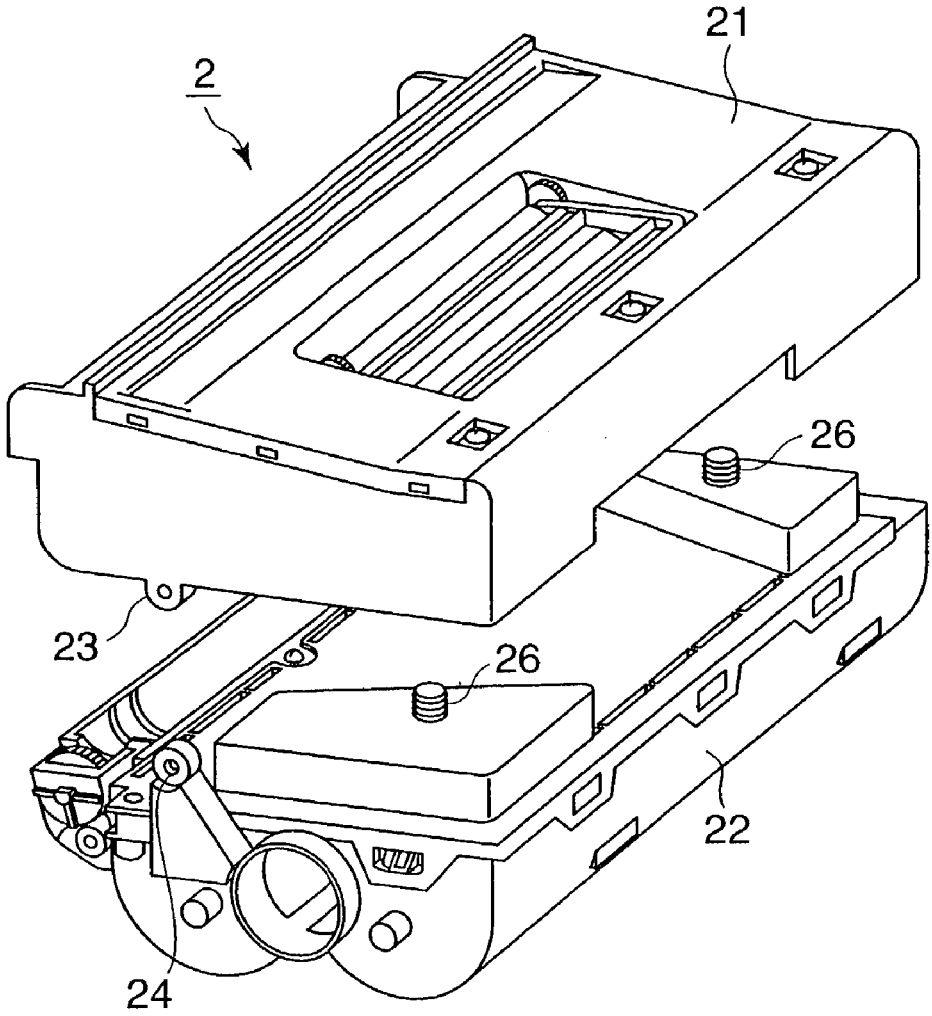
FIG. 5 is an exploded perspective view of the process cartridge.
Figure 6:
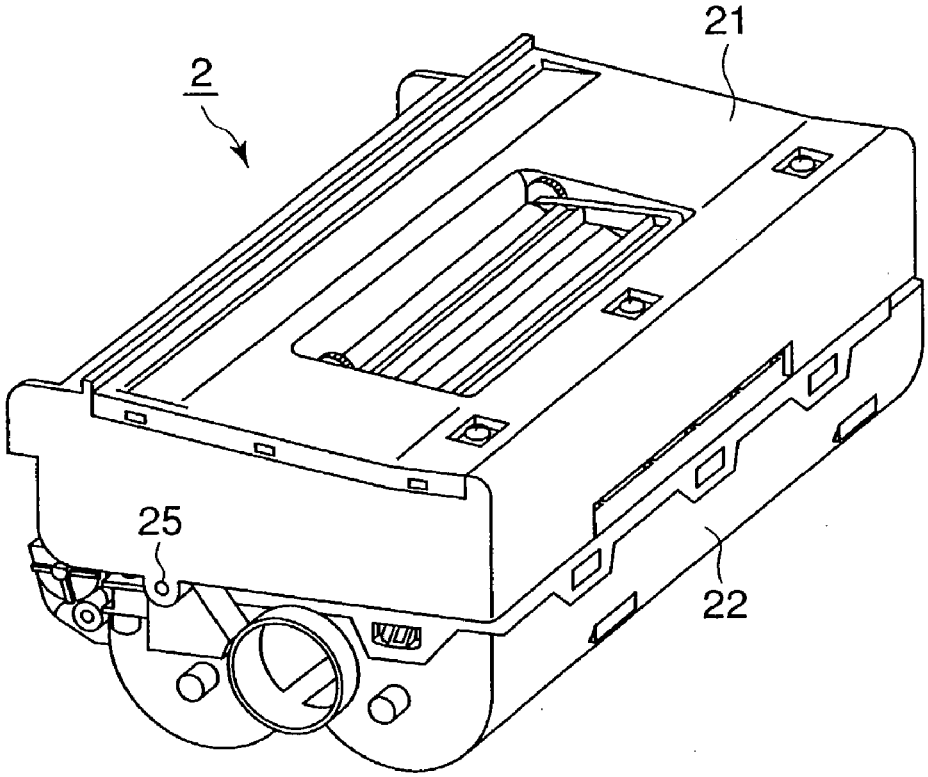
FIG. 6 is an outer-appearance perspective view of the process cartridge.
Figure 7:
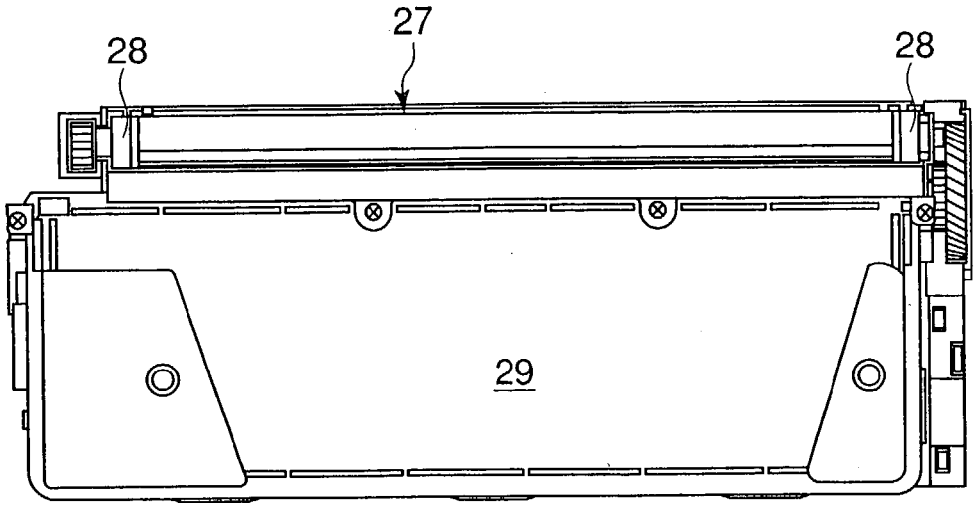
FIG. 7 is an exploded plan view of the process cartridge.

The process cartridge 2 is composed by an upper cartridge 21 and a lower cartridge 22 as shown in FIGS. 5 and 6. The upper cartridge 21 and the lower cartridge 22 are coupled tiltably around engaging pins 25 with engaging portions 23 and 24 and the engaging pins 25 which are provided at both end portions in a width direction of the cartridges. Further, as shown in FIG. 5, the upper cartridge 21 and the lower cartridge 22 are biased by springs 26 provided on an upper surface of the lower cartridge 22. As a result, the photosensitive drum 3 is in press-contact with tracking rolls 28 provided at both end portions of a developing roll 27 in the developing device 5 under a predetermined pressure (for example, 2 kg on one side) as shown in FIGS. 7 and 8.

Figure 8:
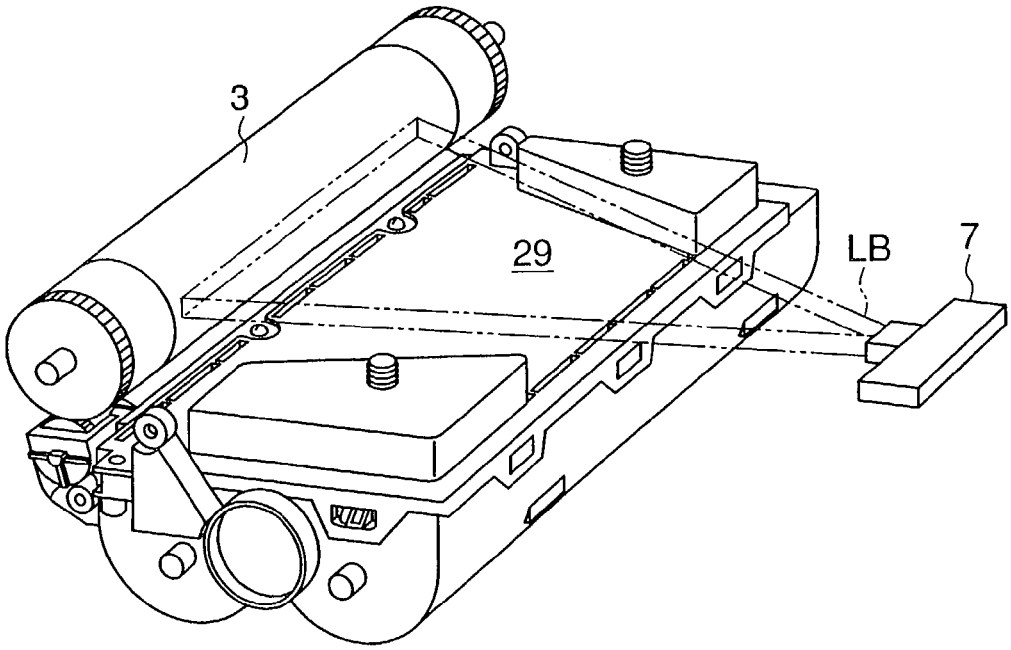
FIG. 8 is an exploded perspective view of the process cartridge.
Figure 9:
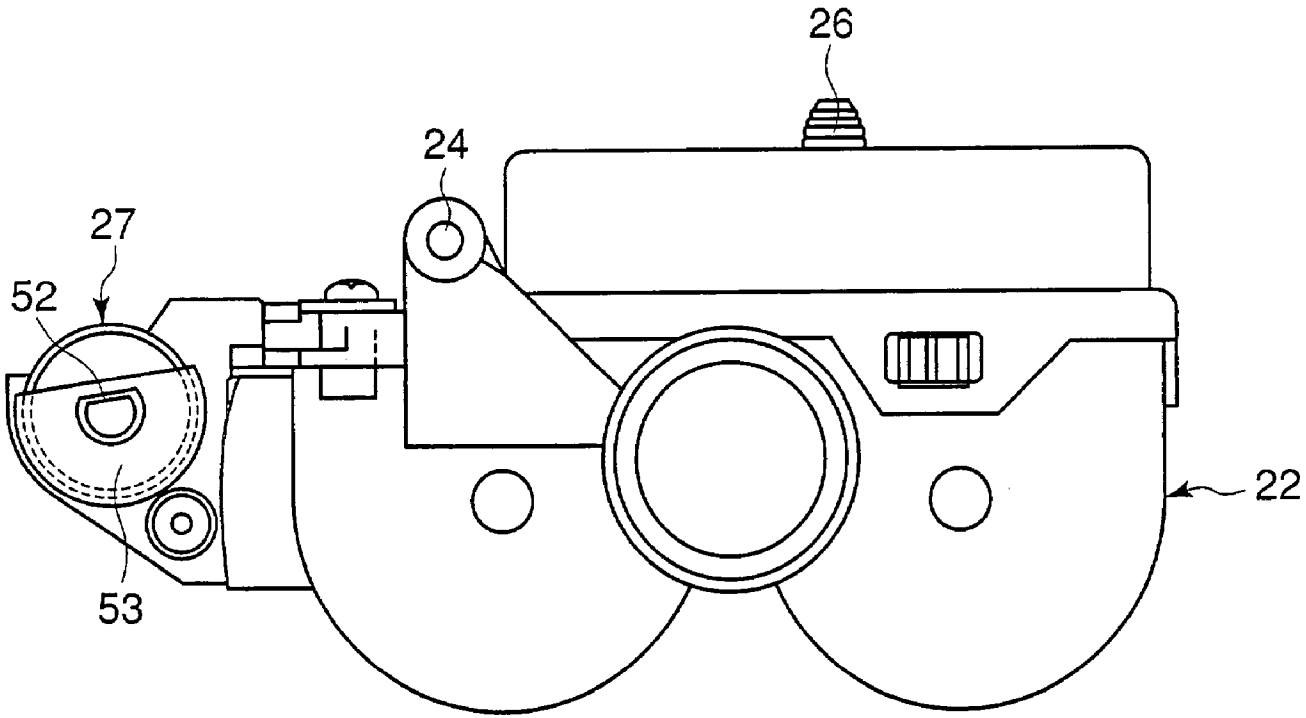
FIG. 9 is a side view of the process cartridge.

Further, as shown in FIG. 8, provided on the upper surface of the lower cartridge 22 is an irradiation space 29 with a substantially fan shape for exposing the surface of the photosensitive drum 3 to the laser beam LB irradiated from the ROS 7.

The photosensitive drum 3 is rotatably attached to one end portion of the upper cartridge 21 as shown in FIG. 4. The charging roll 4 is provided adjacent to the photosensitive drum 3. Further, a cleaning blade 31 in the cleaning device 6 is arranged in the periphery of the photosensitive drum 3 and in the portion above the charging roll 4. Further, the cleaning device 6 is provided with a recovered-toner conveying member 32 that conveys a recovered-toner removed by the cleaning blade 31 and a recovered-toner containing chamber 33 that contains the recovered-toner conveyed by the recovered-toner conveying member 32. The recovered-toner receiving chamber 33 occupies a large part of the upper cartridge 21. Moreover, the upper cartridge 21 is provided with a cover 34 which is openable and closable and which covers the surface of the photosensitive drum 3. The cover 34 generally covers the surface of the photosensitive drum 3 as shown in FIG. 4, and prevents deterioration of the photosensitive drum 3 due to exposure. Furthermore, in the state in which the process cartridge 2 is mounted at a predetermined position in the printer main body 1, the cover 34 is automatically opened in accordance with the mounting operation so that the photosensitive drum 3 contacts with the transfer roll 9 as shown in FIG. 3.

On the other hand, the lower cartridge 22 constitutes the developing device 5 itself as shown in FIG. 4. The developing roll 27 is arranged rotatably at one end portion of a housing 35 in the developing device 5. A layer thickness regulating member 36, which exposes the toner to frictional electrification and regulates a thickness of the toner, is in contact with the surface of the developing roll 27. Arranged on the back surface side of the developing roll 27 is a toner supply member 37 which is rotatable and which supplies the toner to the surface of the developing roll 27. On the back surface side of the toner supply member 37, a toner receiving portion 39, which occupies a large part of the developing device 5, is provided integrally through an opening portion 38 for toner supply. A bottom surface 40 of the toner receiving portion 39 is formed into a shape in which two parts 41 and 42 each having a substantially arc-shaped section are lined. Arranged inside the toner receiving portion 39 are toner agitating and conveying members 43 and 44 which are rotatable and which agitate the contained toner and simultaneously convey the toner sequentially from the second toner receiving portion 42 on the inner side to the first toner receiving portion 41 on the developing roll 27 side.

Note that a toner sensor 45 that detects the presence and absence of a toner is provided on the bottom surface of the first toner receiving portion 41 as shown in FIG. 3.

Figure 1:
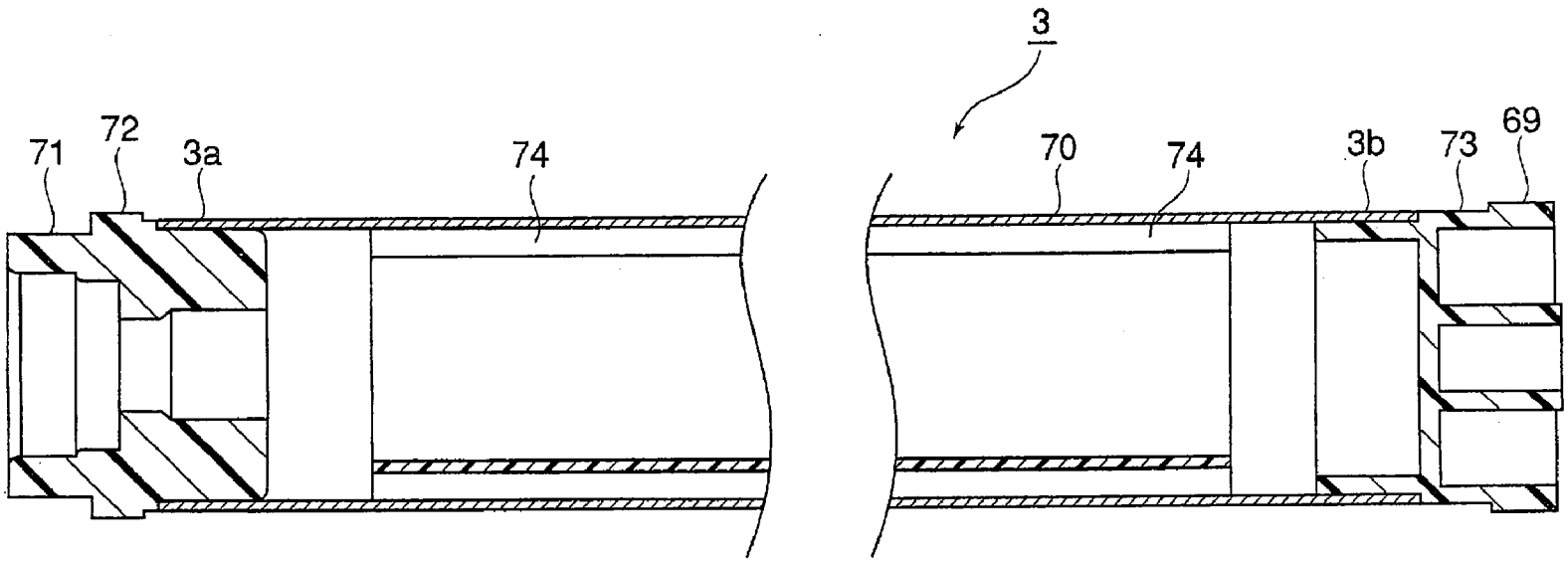
FIG. 1 is a sectional view of a photosensitive drum that uses a sound deadening member for an electrophotographic photosensitive body which serves as a recycled part for an image forming apparatus to which a recycling method and a recycling apparatus of a part for an image forming apparatus in accordance with Embodiment 1 of the present invention are applied.
Figure 2:
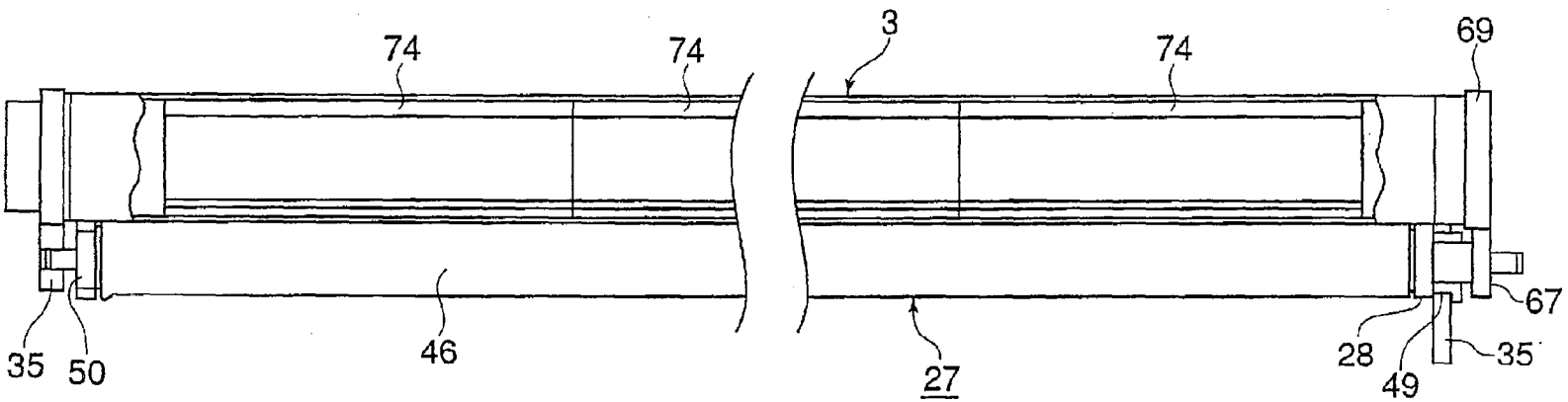
FIG. 2 is a sectional view of a main portion of a process cartridge that serves as a recycled part for an image forming apparatus to which the recycling method and the recycling apparatus of a part for an image forming apparatus in accordance with Embodiment 1 of the present invention are applied.

FIGS. 1 and 2 each show a photosensitive drum used in a digital printer as an image forming apparatus to which the recycling method and the recycling apparatus of a part for an image forming apparatus and the recycled part for an image forming apparatus in accordance with Embodiment 1 of the present invention are applied.

By the way, the photosensitive drum 3 is structured by covering a surface of a thin cylindrical drum 70 made of metal such as aluminum with an organic photoconductor (OPC) or the like as shown in FIGS. 1 and 2. One end portion 3*a* (left end portion in FIG. 1) of the photosensitive drum 3 is provided with a rear side flange member 72 through press fitting (press fitting and adhesion if necessary) A gear 71 that drives and rotates the photosensitive drum 3 is formed integrally with the rear side flange member 72. Further, the other end portion 3*b* (right end portion in FIG. 1) of the photosensitive drum 3 is provided with a front side flange member 73 through press fitting (press fitting and adhesion if necessary). A gear 69 that drives and rotates the developing roll 27 in the developing device 5 is formed integrally with the front side flange member 73.

Further, as shown in FIG. 2, the inner circumference of the photosensitive drum 3 is anchored with three sound deadening members 74 (thermoplastic resin members) for an electrophotographic photosensitive body which are made of thermoplastic resin in an axial direction. These sound deadening members 74 for an electrophotographic photosensitive body are for preventing occurrence of noise due to application of an alternating voltage to the charging roll 4 in performing uniform charging to the surface of the photosensitive drum 3 by means of the charging roll 4 (refer to FIG. 4). The sound deadening member 74 is provided with an opening portion 74A with a thickness of 0.5 mm or more at a location along a circumferential direction of the cylindrical section and is provided with a hinge portion 74B with a thickness equal to or less than half a general thickness of the member as shown in FIG. 10C. When the sound deadening member 74 is provided to the inner circumferential surface of the photosensitive drum 3, a portion with the general thickness is formed along an outer diameter of the member so as to be in close contact with the inner circumference of the photosensitive drum 3. The sound deadening member 74 is structured as described above because the member is easily inserted into or detached from the inner circumference of the photosensitive drum 3 and at the same time, since the member is anchored to the photosensitive drum 3 in a close contact manner. Further, the sound deadening member 74 is formed of thermoplastic resin such as ABS resin or vinyl chloride resin. In this embodiment, the sound deadening member 74 is formed of ABS resin. Note that resins other than the above resins may be used as the thermoplastic resin for forming the sound deadening member 74, of course.

Moreover, the sound deadening member 74 is not limited to one with the above-described shape. As the sound deadening member 74, there may be used one with a section having a substantially C shape as shown in FIG. 11A or one with a coil shape as shown in FIG. 11B, of course.

By the way, the recycling method of a part for an image forming apparatus in accordance with this embodiment is a recycling method of a part for an image forming apparatus, the part being used in the image forming apparatus and provided with a thermoplastic resin member at least in a part thereof, which is structured to include the steps of: recovering the part for the image forming apparatus; disassembling the recovered part for the image forming apparatus; retrieving the thermoplastic resin member from the disassembled part for the image forming apparatus; preheating the retrieved thermoplastic resin member; and performing heat processing to the thermoplastic resin member to recycle the member after the preheating step.

Further, the recycling method of a part for an image forming apparatus in accordance with this embodiment may be structured to include a step of retrieving a sound deadening member from a photosensitive drum and a step of expanding an end portion of the photosensitive drum before the retrieving step.

First, the digital printer, in which the sound deadening member 74 for an electrophotographic photosensitive body is used, is subjected to a step of recovering the used digital printer in a resource environment type production system. Thereafter, the recovered digital printer is sent to a recycling plant, and is disassembled to retrieve individual parts such as the photosensitive drum 3. Note that in the digital printer, the process cartridge 2 including the photosensitive drum 3 is interchangeable separately from the printer main body 1. Therefore, the process cartridge 2 that is independently recovered is disassembled to retrieve individual parts such as the photosensitive drum 3.

As to the disassembled part for an image forming apparatus such as the photosensitive drum 3, the sound deadening member 74 for an electrophotographic photosensitive body is retrieved in the recycling plant as follows. The sound deadening member 74 for an electrophotographic photosensitive body is recycled as a recycled part for an image forming apparatus, and then, is again mounted to a new photosensitive drum 3, thereby being used for assembly of the process cartridge 2 as a new product including the recycled part for an image forming apparatus.

Next, a recycling method of the sound deadening member 74 for an electrophotographic photosensitive body which serves as the part for an image forming apparatus will be described for each step with reference to FIG. 12 and the like. Note that FIG. 12 illustrates the recycling method of the sound deadening member 74 for an electrophotographic photosensitive body which serves as the part for an image forming apparatus for the sake of convenience, and thus, the steps shown in FIG. 12 are not necessarily performed.

Retrieving Step

Figure 12:
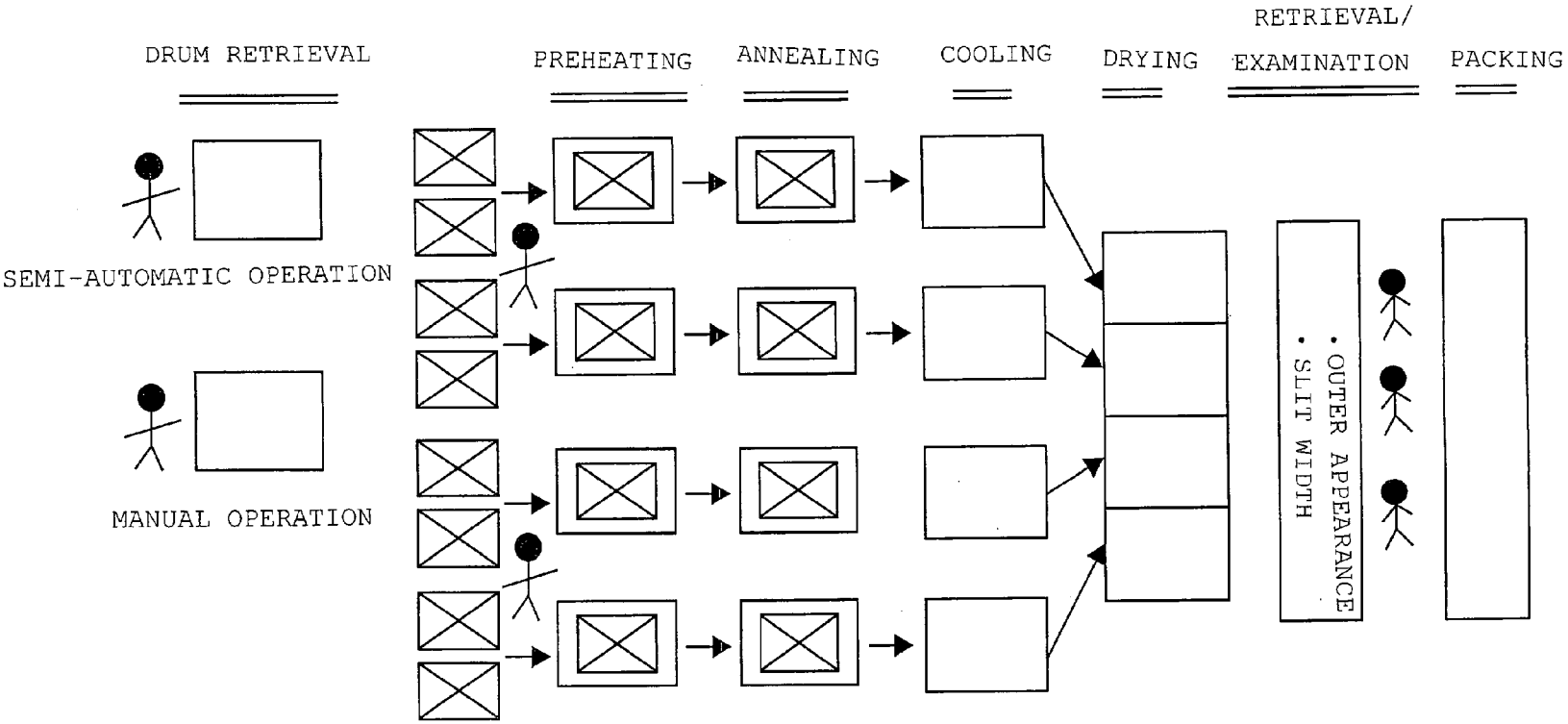
FIG. 12 is a step explanatory diagram of the recycling method of a part for an image forming apparatus in accordance with Embodiment 1 of the present invention.

As shown in the left end of FIG. 12, there is performed the step of retrieving the sound deadening member 74 for an electrophotographic photosensitive body from the photosensitive drum 3 recovered as described above. In the step of retrieving the sound deadening member 74, there is used an equipment provided with a drum flange disassembling device 75 that automatically retrieves the sound deadening member 74 as shown in FIG. 13A or an equipment provided with a sound deadening member retrieving device 76 that retrieves the sound deadening member 74 by human hands as shown in FIG. 13B. The drum flange disassembling device 75 is a device for cutting both end portions of the photosensitive drum 3 by means of a cutter to thereby automatically retrieve the sound deadening member 74. Further, the sound deadening member retrieving device 76 is a device for removing the flange members that are press-fitted to both the end portions of the photosensitive drum 3 and then retrieving the sound deadening member 74 with human hands. Both the devices have advantages and disadvantages from the viewpoint of cost, working hours, and the like. Thus, one of the devices is appropriately selected to perform the step of retrieving the sound deadening member 74.

Figure 14:
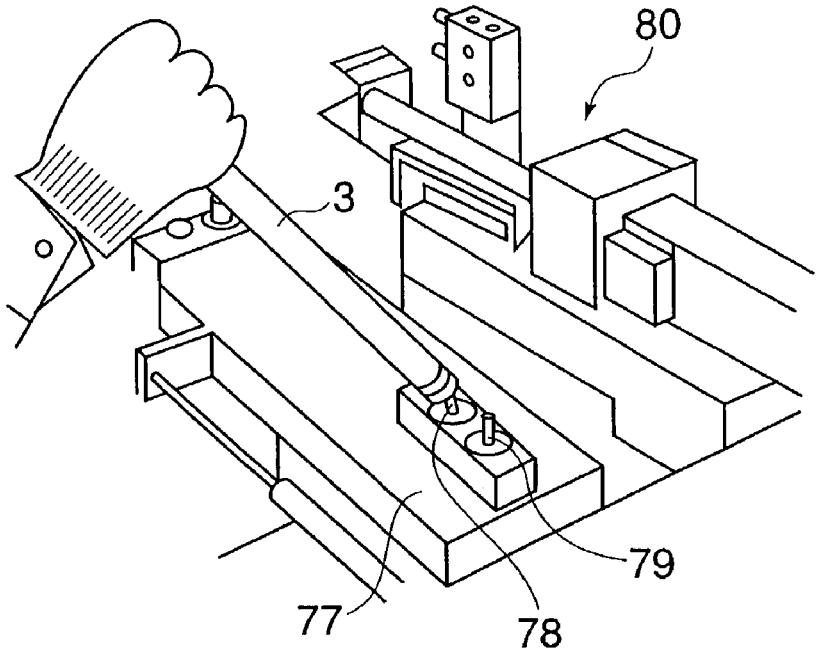
FIG. 14 is an explanatory diagram of the retrieving step.

Here, description is made with an example of the equipment provided with the sound deadening member retrieving device 76. With the sound deadening member retrieving device 76, the photosensitive drum 3 is retrieved from a drum recovery box, and the rear side flange member 72 in the photosensitive drum 3 is inserted into a thick-flange removing fitting 78 fixed onto a workbench 77 as shown in FIG. 14. The thick-flange removing fitting 78 is for removing the rear side flange member. The flange member 72 is removed by folding the photosensitive drum 3 toward the front side by one hand. Next, the photosensitive drum 3 is inverted and held, and the front side flange member 73 in the photosensitive drum 3 is inserted into a thin-flange removing fitting 79 similarly fixed onto the workbench 77. The thin-flange removing fitting 79 is for removing the front side flange member. The flange member 73 is removed by folding the photosensitive drum 3 toward the front side by one hand. Thereafter, the flange members 72 and 73, which are respectively left in the fittings 78 and 79 of the sound deadening member removing device 76, are removed to be put in a not-shown flange recovery box. Note that it is confirmed that a ground plate (not shown) made of a small metal piece remains in the photosensitive drum 3 after both the flange members 72 and 73 are removed. In the case where the ground plate remains in the photosensitive drum 3, the ground plate is removed by means of a pair of radio pliers or a driver.

Next, two photosensitive drums 3 are slightly beaten with each other twice or three times to move the sound deadening member 74 inside the drum to one end (for example, left end). Thereafter, the photosensitive drum 3 is set in a sound deadening member retrieving machine 80, and a starting switch of the sound deadening member retrieving machine 80 is pushed. At this time, the sound deadening member is easily retrieved when the photosensitive drum 3 is set in the sound deadening member retrieving machine 80 with the side from which the flange has been taken out on the right side. Further, the photosensitive drum 3 is set by being pressed at the left end against the machine.

Figure 15:
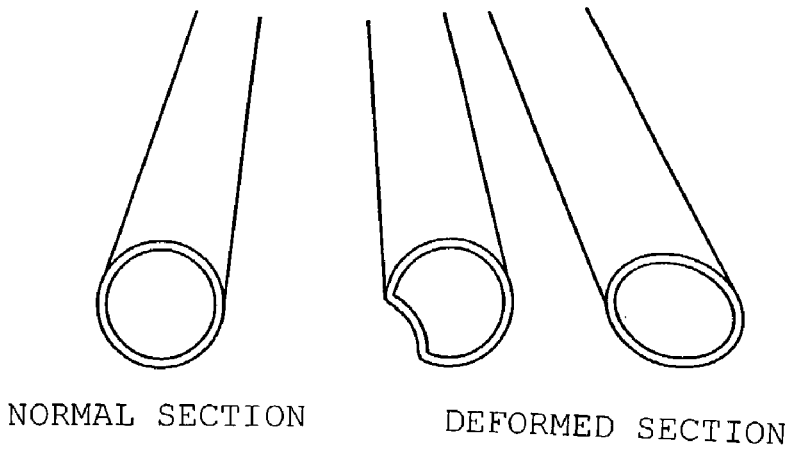
FIG. 15 is an explanatory diagram of a state in which a photosensitive drum is deformed.

When an end surface of the photosensitive drum 3 on the side from which the flange has been taken out is deformed as shown in FIG. 15, the photosensitive drum 3 is inversely set. Further, when both the ends of the photosensitive drum 3 are deformed, the photosensitive drum 3 is set such that the end with less deformation is on the right side. Alternatively, the photosensitive drum 3 is set after the end is altered to expand with a pair of radio pliers or the like. Note that work must be started after a safety cover of a cutter portion of the sound deadening member retrieving machine 80 is closed.

Figure 16:
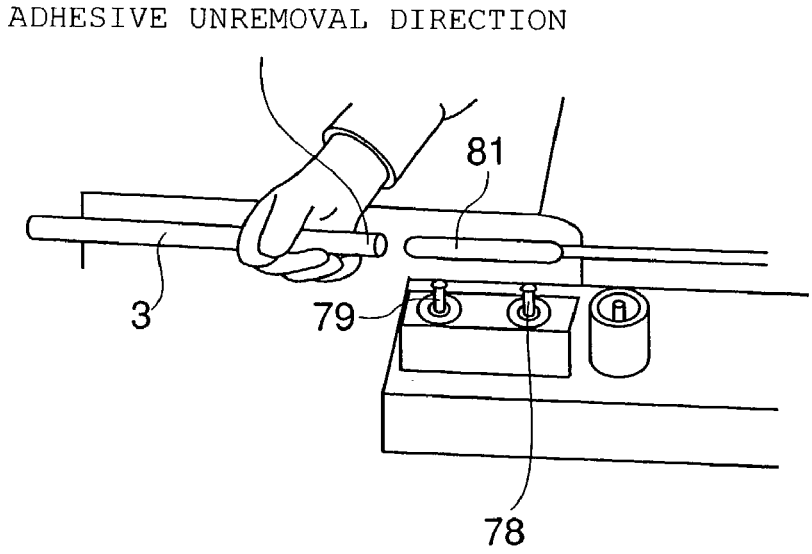
FIG. 16 is an explanatory diagram of the retrieving step of a sound deadening member.
Figure 17:
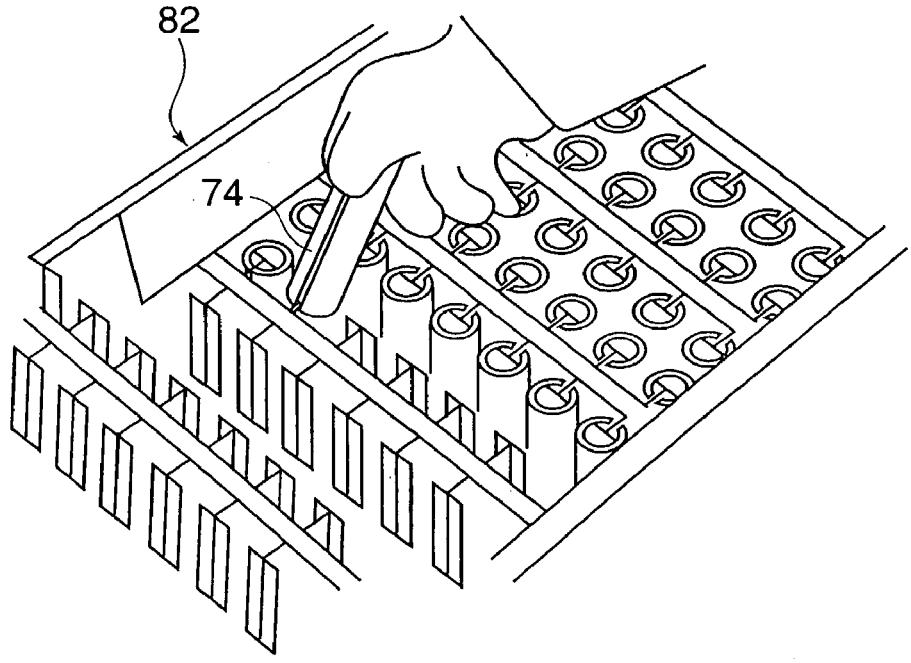
FIG. 17 is an explanatory diagram of a state in which the sound deadening member is set in a jig.

Next, the photosensitive drum 3 is removed from the sound deadening member retrieving machine 80, and then, is inverted to be beaten so that dust of an adhesive is removed. Thereafter, as shown in FIG. 16, the photosensitive drum 3 is set to a sound deadening member extruding rod 81 in a direction in which an adhesive has not been removed to extrude and retrieve three sound deadening members 74. The left aluminum pipe (resultant photosensitive drum obtained by retrieving the three sound deadening members) 3 is put into a not-shown aluminum recovery box.

The sound deadening member 74 retrieved as described above is automatically set in an air washing machine called Ion Ace. Then, the sound deadening member 74 is subjected to air washing by Ion Ace to be stored in a stock box. When being stuffed, the stock box is replaced. Further, the sound deadening member 74 made of vinyl chloride and the sound deadening member 74 made of ABS are sorted out to be stocked in separate stock boxes.

Preheating Step

Thereafter, a preheating step is performed to the sound deadening member 74 as shown in FIG. 12. In the preheating step, the sound deadening member 74 is taken out from the stock box, and is set in a jig 82 as shown in FIGS. 17 and 18A to 18C. Note that, when the sound deadening member 74 is set in the jig 82, attention needs to be paid to prevent the sound deadening member 74 from being hurt by a metal portion of the jig 82. Further, attention needs to be paid to prevent both the sound deadening member 74 made of vinyl chloride and the sound deadening member 74 made of ABS from being mixed since they are each subjected to the heat-processing step at a different temperature and the like.

Figure 18:
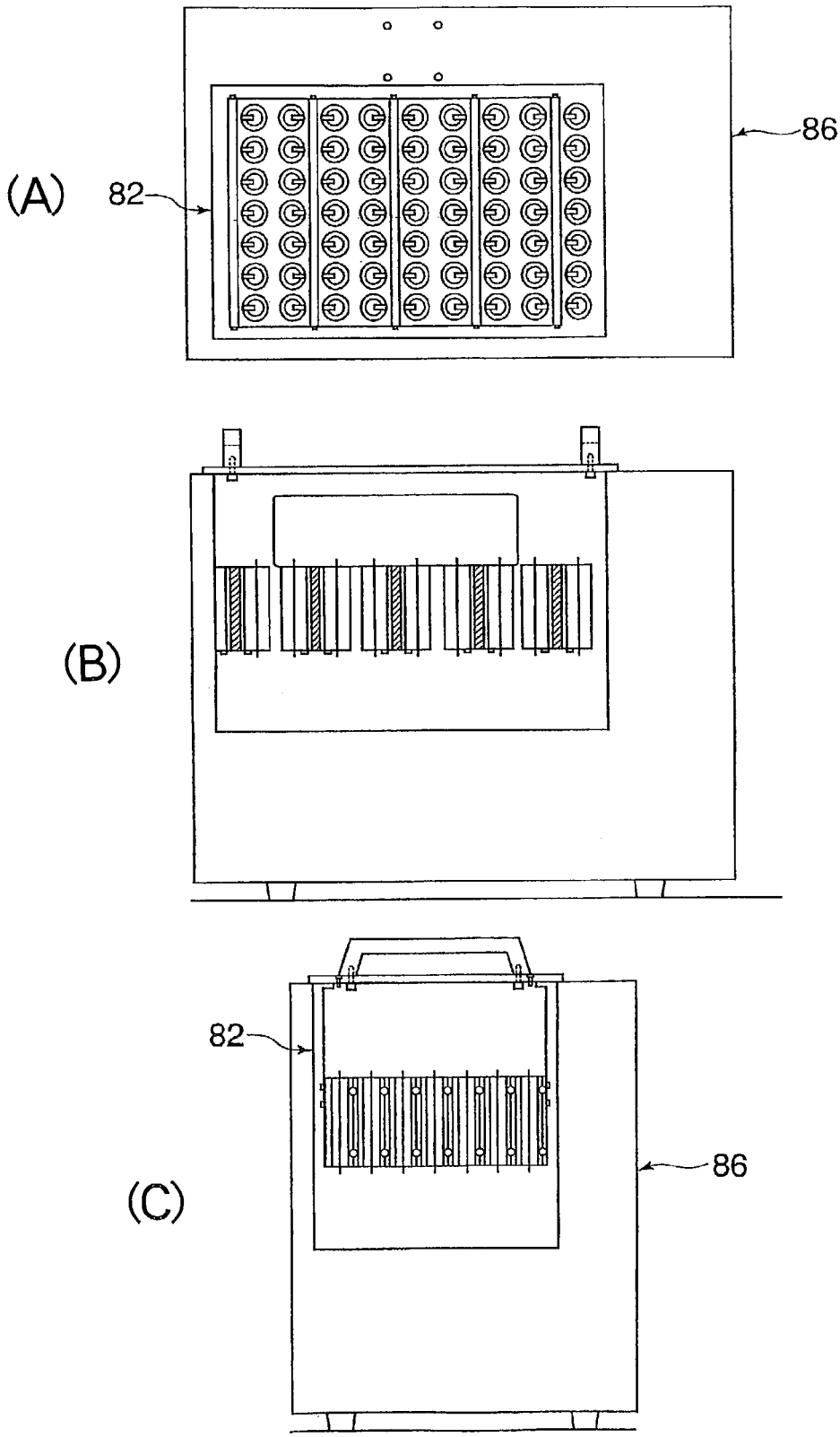
FIGS. 18A to 18C are structural views of an apparatus used in a preheating step and a heat-processing step.
Figure 19:
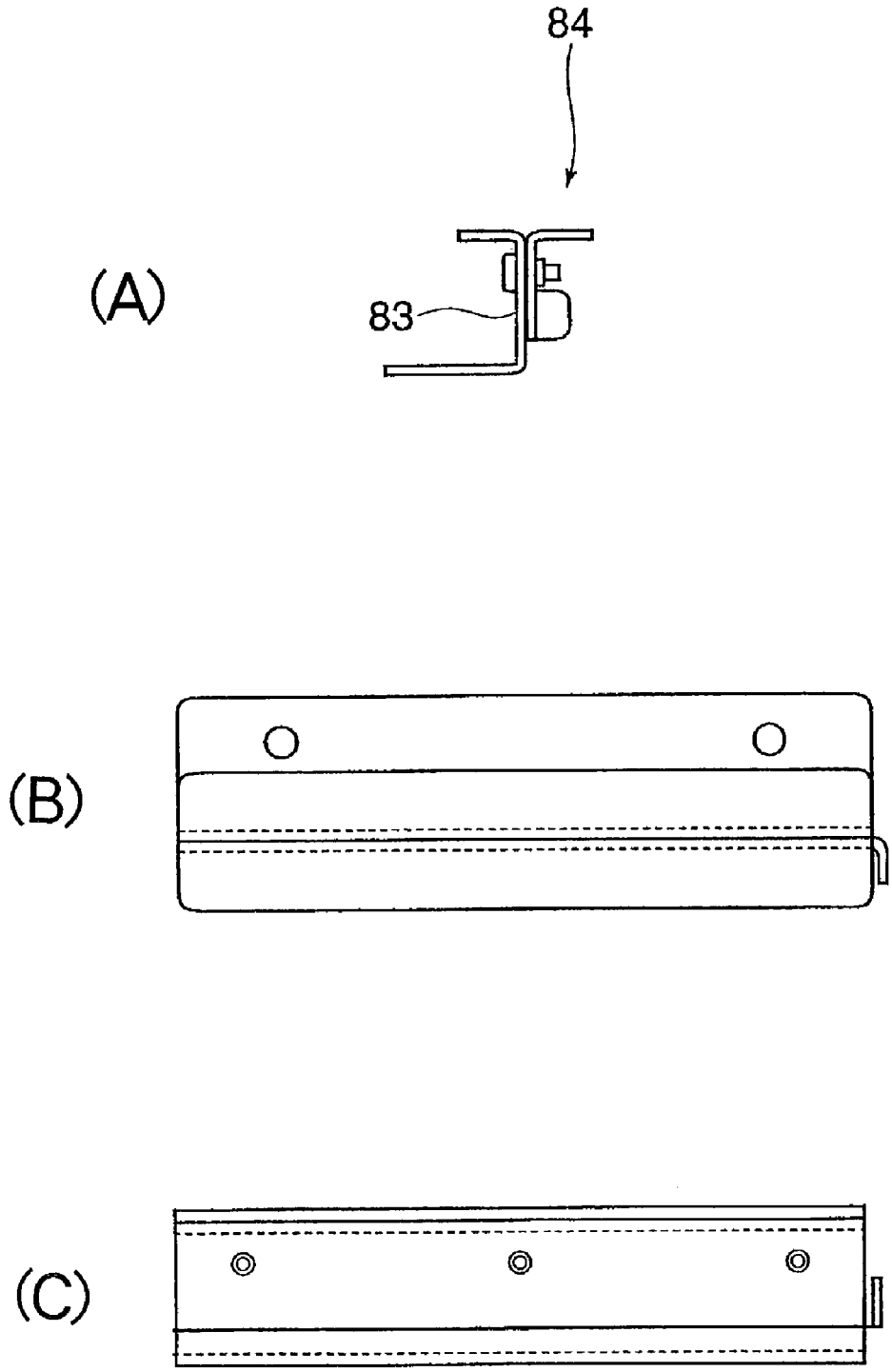
FIGS. 19A to 19C are structural views of parts for a jig used in the preheating step and the heat-processing step.
Figure 20:
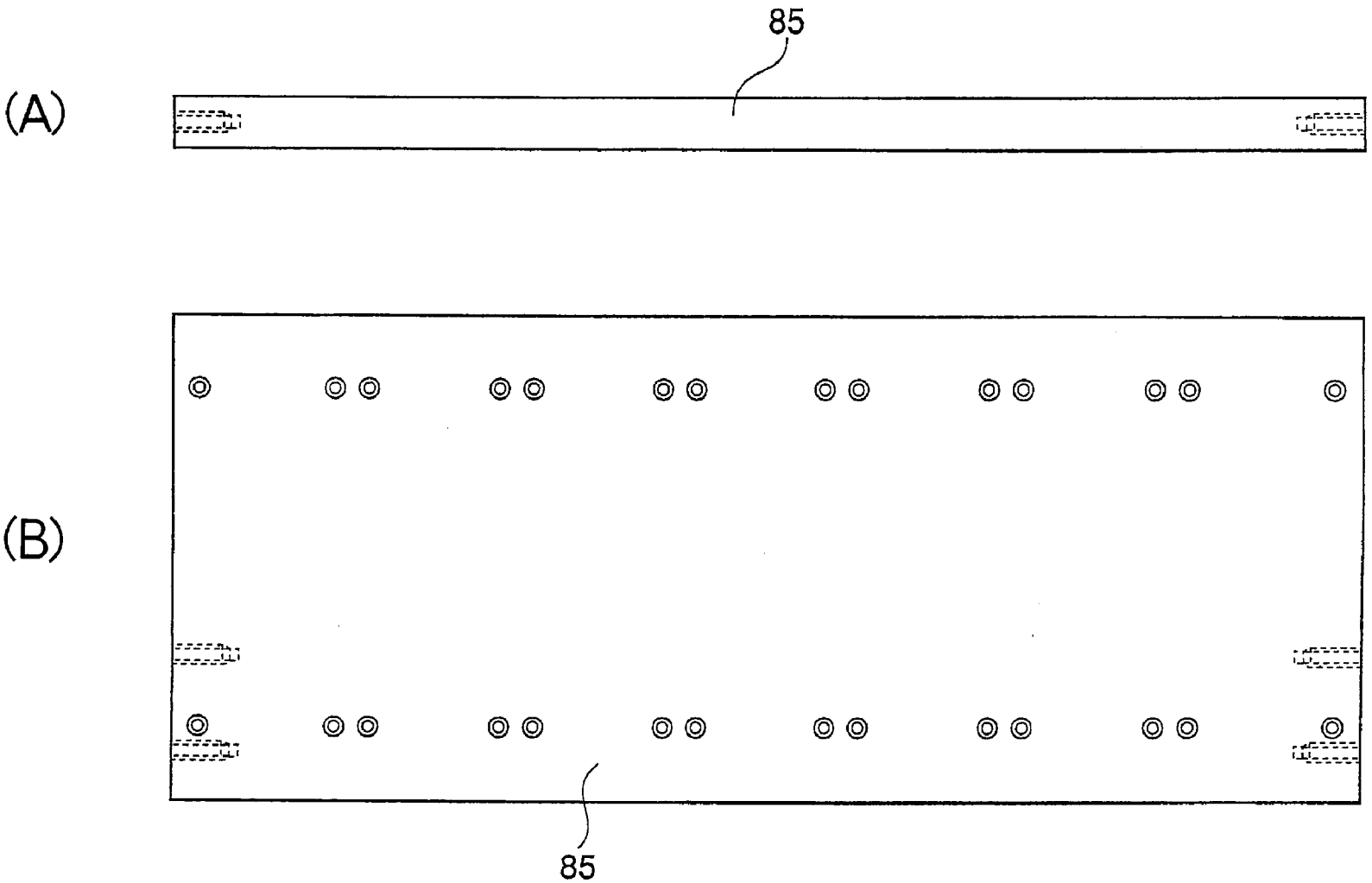
FIGS. 20A and 20B are structural views of a part for the jig used in the preheating step and the heat-processing step.

The jig 82 is formed by attaching predetermined number of correction jigs 84, each of which has a substantially T shape as shown in FIGS. 19A to 19C and which is inserted into a hollow portion of the sound deadening member 74, to both surfaces or one surface of a plate 85 as shown in FIGS. 20A and 20B. The correction jig 84 is provided with an insertion portion 83 with a predetermined thickness which puts the slit-like opening portion 74A of the sound deadening member 74 therethrough. The jig 82 shown in FIGS. 18A to 18C can be mounted with 63 sound deadening members 74 at a time.

Next, the jig 82 mounted with the predetermined number of sound deadening members 74 is immersed in hot water in a constant temperature bath 86 for a predetermined time to perform the preheating step as shown in FIGS. 18A to 18C. In the case where the sound deadening member 74 is made of ABS resin, the preheating step is performed at 25° C., and the time for the step is made to match with the time for the heat-processing step described below (for example, 10±0.5 min.). Further, in the case where the sound deadening member 74 is made of vinyl chloride resin, the preheating step is performed at 25° C., and the time for the step is made to match with the time for the heat-processing step (for example, 10±0.5 min.). As the constant temperature bath 86, for example, T-104NB made by Thomas Kagaku Co., Ltd. is used as shown in FIGS. 21A to 21C. In FIGS. 21A to 21C, reference numeral 861 denotes an agitation motor; 862 denotes a water bath top plate; 863 denotes a shelf receiving rail; 864 denotes an exterior; 865 denotes a heat insulating material; 866 denotes an inner bath; 867 denotes a shelf; 868 denotes a drain hole; 869 denotes a drain valve; 870 denotes a rubber foot; 871 denotes a heater; 872 denotes an agitation propeller; 873 denotes an electrode for detection of water-level lowering; 874 denotes a temperature sensor; 875 denotes an operation panel; 876 denotes a power source cord; 877 denotes a thermometer holder; and 878 denotes a lid handle of a water bath. Note that the time for the preheating step may be made different from the time for the heat-processing step explained next, and maybe set to, for example, about 12 minutes. However, the result does not change even if the time for the preheating step is 10 minutes as in the heat-processing step. Thus, the time for the preheating step is desirably made to match with the time for the heat-processing step in consideration of a merit that the preheating step and the heat-processing step can be performed synchronously or other merits.

Heat-Processing Step

Subsequently, the heat processing (annealing) step is performed to the sound deadening member 74 as shown in FIG. 12. As shown in FIGS. 18A to 18C, the heat-processing step is performed by pulling up, from the constant temperature bath 86 for the preheating step (preheating machine), the jig 82 mounted with the predetermined number of sound deadening members 74 as in the preheating step and by immersing the jig 82 in hot water in a constant temperature bath 87 for the heat-processing step (annealing machine) for a predetermined time. Note that the constant temperature bath 87 for the heat-processing step is structured similarly to the constant temperature bath 86 for the preheating step shown in FIGS. 21A to 21C except the point that the setting temperature differs.

In the case where the sound deadening member 74 is made of ABS resin, the heat-processing step is performed by immersing the sound deadening member 74 in hot water at a temperature of 68±1° C. in the constant temperature bath 87 for 10±0.5 minutes. Further, in the case where the sound deadening member 74 is made of vinyl chloride resin, the heat-processing step is performed by immersing the sound deadening member 74 in hot water at 65±1° C. in the constant temperature bath 87 for 10±0.5 minutes. The temperature in the heat-processing step is set to a temperature equal to or lower than a deflection temperature under load of thermoplastic resin that forms the sound deadening member 74.

As described above, through the heat-processing step, the sound deadening member 74, which has been used once and deformed, is restored with original predetermined dimensions and shape to be reused.

Note that, after the heat-processing step, there may be performed a cooling step for immersing the sound deadening members in the state of being mounted in the jig in running water. However, the cooling step may be omitted.

Further, in performing the heat-processing step, heat processing is desirably performed in the state in which the opening portion 74A of the sound deadening member 74 is expanded by the correction jig 84.

Further, the heat-processing step is performed by immersing the thermoplastic resin member in hot water. The heat-processing step may also serve as a step of cleaning attachment attached to the thermoplastic resin member.

Moreover, the hot water is set to a temperature in a range of 45° C. to 90° C.

Furthermore, the temperature of the heat-processing step is set to a temperature equal to or lower than the deflection temperature under load of the thermoplastic resin member.

Drying Step

Figure 22:
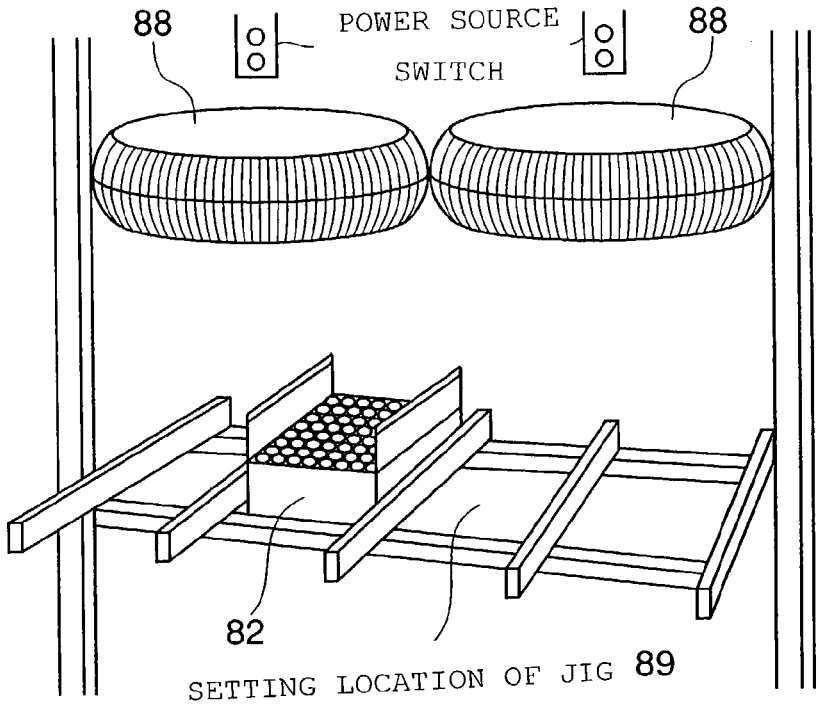
FIG. 22 is an explanatory view of a drying step.

Thereafter, the sound deadening members 74 that has undergone the heat-processing step are pulled up together with the jig 82 from the constant temperature bath 87, and they are set in a predetermined setting location of drying machines 88 as shown in FIG. 22. Then, power source switches of the drying machines 88 are turned on. In addition, the sound deadening members 74 mounted in the jig 82 are sprayed with an air blow jetted from an air hose connected with a not-shown compressor by manual operation, thereby completely blowing off water. Then, after the elapse of 10 minutes from turning-on of the power source switches of the drying machines 88, the switches are turned off. Thus, the drying step is completed. Then, as shown in FIG. 12, the jig 82 mounted with the sound deadening members 74 is moved to a not-shown examining table. Note that the air blow is jetted for 3±0.5 minutes.

Examination Step

Figure 23:
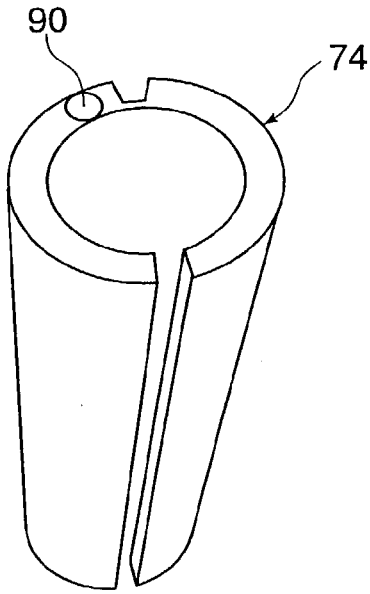
FIG. 23 is a structural view of a recycled sound deadening member.

Next, the sound deadening members 74 are pulled up one by one from the jig 82 by an operator, and an end surface of the sound deadening member 74 is marked with an R mark 90 for discrimination of a recycled product as shown in FIG. 23. In the case where the number of times of recycling increases to twice, three times etc., another R mark 90 for discrimination of a recycled product is put at, for example, a position adjacent to the R mark 90 for discrimination of a recycled product which has been previously put. The marking is performed using, for example, a white marker. Further, the surface and the end surface of the sound deadening member 74 is examined with visual observation in accordance with a boundary sample. The examination with visual observation is performed by confirming with visual observation that there is no burr or that a scar and a chip are at a level lower than that of the boundary sample, for example. Note that in the case where burrs exist on the surface of the sound deadening member 74, examination is again performed after the burrs are removed. Then, it is confirmed that a scar and a chip are at a level lower than that of the boundary sample. Further, a rejected product is recovered and put into a container for rejected products.

Figure 24:
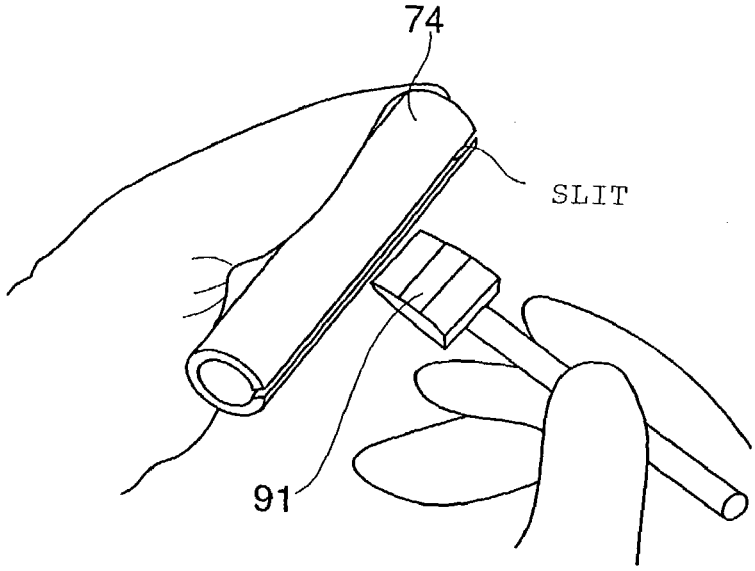
FIG. 24 is an explanatory view of an examining step.

Further, as shown in FIG. 24, a NOGO gauge 91 is inserted into the center part of the slit-like opening portion 74A of the sound deadening member 74 to examine whether the width of the slit is in a predetermined range. In the case of the sound deadening member 74 made of vinyl chloride, the standard value of the slit width is set to 3.05±0.45 mm. On the other hand, in the case of the sound deadening member 74 made of ABS resin, the standard value is not particularly limited, but is set to, for example, 2.60 mm. Further, the NOGO gauge 91 is set such that the thickness of its leading end portion changes stepwise to have a predetermined value. A product, in which the NOGO gauge 91 cannot be entered into the slit, or a product, which is not caught by the first step of the gauge, is recognized as a rejected product. Note that the examination step is performed to all the sound deadening members 74.

Figure 25:
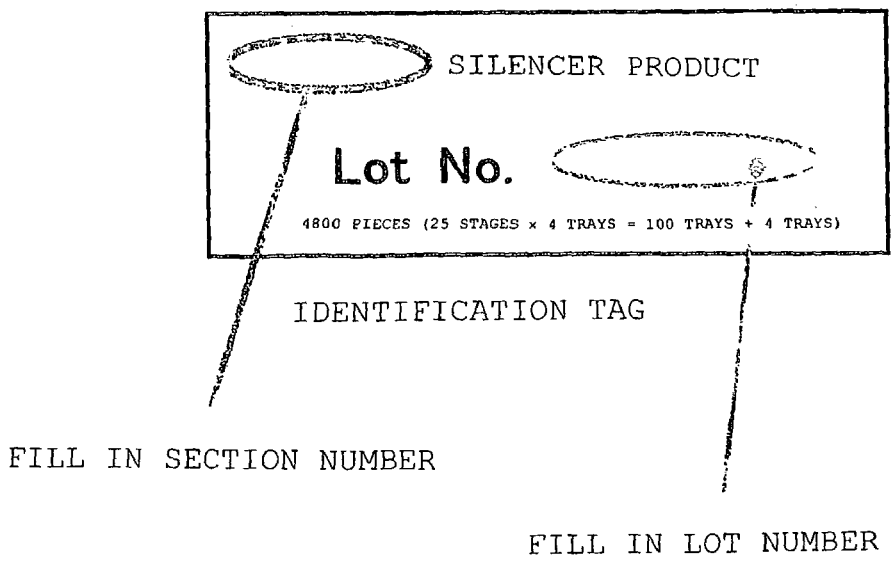
FIG. 25 is an explanatory view of a label attached to a lot of the recycled sound deadening member.

Thereafter, the sound deadening members 74 that have passed the examination step are put in not-shown trays in a unit of, for example 48 pieces, and are palletized to form two pallets of 4 trays×25 stages=100 trays (4800 pieces of the sound deadening members) Then, as shown in FIG. 25, an identification tag filled in with necessary information is attached to the trays. Four trays are put on the uppermost stage as lids, and the whole trays are wrapped in plastic wrap. The resultant whole trays are delivered as recycled sound deadening members 74 to an assembly plant of a process cartridge. The sound deadening members 74 are used for assembly of a new process cartridge. Note that the date of production is used as a lot number, for example, Lot No. 980114 corresponding to the products produced on Jan. 14, 1998.

As described above, the sound deadening member 74 that has been used once is recycled through the respective steps to be used for assembly of the new process cartridge 2. In this case, even if being deformed due to the use and changed in the width of the slit-like opening portion 74A, the sound deadening member 74 can be restored with original dimensions and shape by being subjected to heat processing. Thus, the used sound deadening member 74 can be reused.

EXPERIMENTAL EXAMPLE 1

The present inventors made confirmation of the effect of the above-described recycling method of a part for an image forming apparatus as follows. That is, the process cartridge 2 that uses the sound deadening member 74 as shown in FIGS. 10A to 10C is recovered after actually being used by a user. Then, the sound deadening member 74 is taken out from the photosensitive drum 3 of the process cartridge 2. Thereafter, an experiment is performed to measure dimensions, shapes, and the like of the respective portions of the sound deadening member 74 as to before and after heat processing.

FIGS. 26A and 26B show results of Experimental Example 1. In the figures, longitudinal lines each indicate a standard range. Note that FIGS. 27 and 28 each show data as the grounds for the similar experiment of the sound deadening member 74 that differs in dimensions from that for FIGS. 26A and 26B.

As apparent from FIGS. 26A and 26B, it is found that the maximum outer diameter of the sound deadening member 74 made of ABS resin involves no problem with the number of times of heat processing being in a range of 1 to 5 because it falls in a standard range, but the maximum outer diameter is out of the standard range with the number of times of heat processing being 6 or more. Further, also as to the radius, it is found that the number of times of heat processing being up to 5 meets the standard range, but the number of times of heat processing being 6 or more is out of the standard range. Further, as to the radial thickness of the sound deadening member, thickness of the hinge portion, total length, straightness, and appearance, the radial thickness of the sound deadening member, thickness of the hinge portion, total length, and straightness meet the standards without problem; on the other hand, as to the appearance, a small number of members vary from the boundary sample. Further, even in the case where the member that does not meet the standard as in the sixth heat processing or the subsequent heat processing, the member can be recycled by using a jig with a shape, for example, a width of its opening portion being set larger or changing heat processing conditions.

As a result, a recycling yield ratio of the sound deadening member 74 made of ABS resin is approximately 95%.

EXPERIMENTAL EXAMPLE 2

Next, the present inventors performed the following experiment in order to determine a heat processing temperature as to the above-described recycling method of a part for an image forming apparatus. That is, the experiment was performed using the sound deadening member 74 made of ABS resin so as to confirm how the dimensions and shape of the sound deadening member 74 differ while the temperature and time in performing heat processing are changed.

Figure 29:
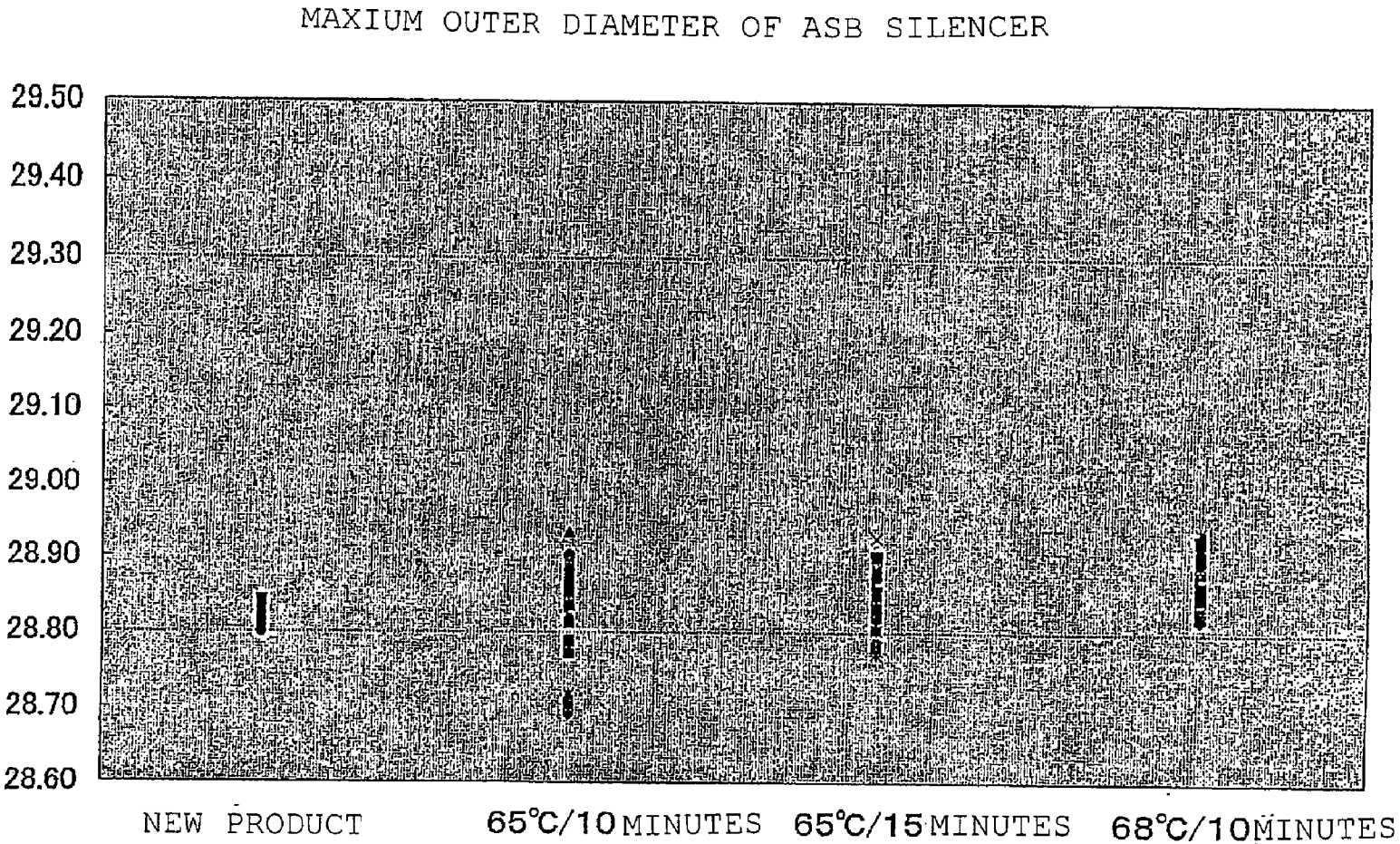
FIG. 29 is a graph showing results of Experimental Example 2.

FIG. 29 shows the result of Experimental Example 2. Note that FIGS. 30 and 31 each show data as the grounds for the experiment.

As apparent from FIG. 29, it is found that, the maximum outer diameter of the sound deadening member 74 made of ABS resin does not meet the standard in some cases at a temperature of a constant temperature bath of 65° C. for both the case of a heat processing time of 10 minutes and the case of a heat processing time of 15 minutes; on the other hand, the maximum outer diameter always meets the standard even with a heat processing time of 10 minutes by setting a temperature of a constant temperature bath to 68° C.

As a result, it is found that it is sufficient for the sound deadening member 74 made of ABS resin that the temperature of the constant temperature bath for heat processing is set to 68° C. and the heat processing time is set to 10 minutes.

EXPERIMENTAL EXAMPLE 3

Further, the present inventors performed the experiment that each sound deadening member is mounted to an actual device to confirm whether there is difference in noise performance between the recycled product of the sound deadening member 74 and the new product of the sound deadening member 74 as to the above-described recycling method of a part for an image forming apparatus. Note that the experiment was performed with the use of Semi-Anechoic Chamber, Ebina Plant Sound-Wave Building, Fuji Xerox Co., Ltd. The sound deadening members 74 used for evaluation include a new product, a recycled product, a recovered product (that clatters when being shaken), a product (that clatters when being shaken) stocked at a normal temperature for one month after a stress test (50° C., 24 hours), a product (that clatters when only being tilted) stocked at a normal temperature for one month after a stress test (50° C., 24 hours), and a product with a flaw (out of a spec).

Figure 32:
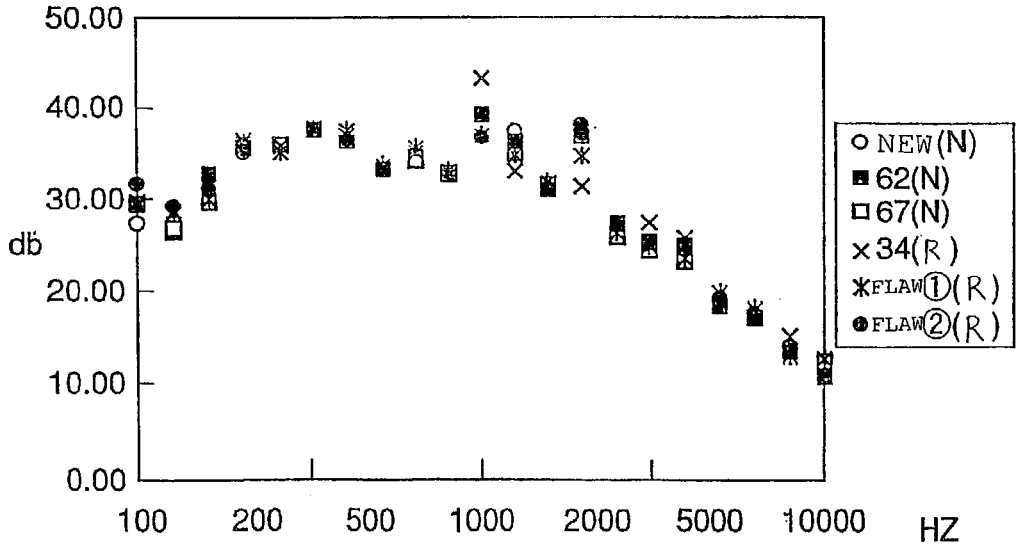
FIGS. 32A and 32B are graphs showing results of Experimental Example 3.

FIG. 32 shows the result of Experimental Example 3.

As apparent from FIG. 32, no difference between a new product and a recycled product is seen in both the long-term stocked product and the defective product with a flaw. Thus, it can be judged that the recycled product of the sound deadening member 74 has the same level in quality as the new product of the sound deadening member 74. Note that the product that clatters when being tilted produces a large discharge sound of 1000 HZ. However, the experimental result shows no difference in sound deadening performance even with a large flaw. Thus, it is considered that the presence or absence of a flaw is irrelevant to the performance of the sound deadening member 74.

Note that FIG. 33 shows the summary of Experimental Examples 1 to 3. As apparent from FIG. 33, the opening portion 74A of the recycled sound deadening member 74 (expansion width of the slit) has a width of 3.03 mm while the opening portion 74A of the new product has a width of 2.94 mm. Thus, the opening portion 74A of the recycled sound deadening member 74 is larger by 3% or more than the opening portion 74A of the new product. Further, the maximum outer diameter of the recycled sound deadening member 74 is larger while the radius is smaller compared with the new sound deadening member 74. It is found that the recycled sound deadening member 74 is deformed in a direction perpendicular to the straight line that connects the opening portion 74A with the hinge portion 74B.

EXPERIMENTAL EXAMPLE 4

Further, the present inventors performed the following experiment as to the above-described recycling method of a part for an image forming apparatus. That is, the time for the preheating step is set to 10 minutes and 12 minutes; and after the heat-processing step, there is or is not performed the cooling step for immersing in running water the jig mounted with the sound deadening members. From the above, it is confirmed whether the difference occurs in the width and the outer diameter of the slit-like opening portion 74A of the recycled sound deadening member 74 under different conditions.

Figure 34:
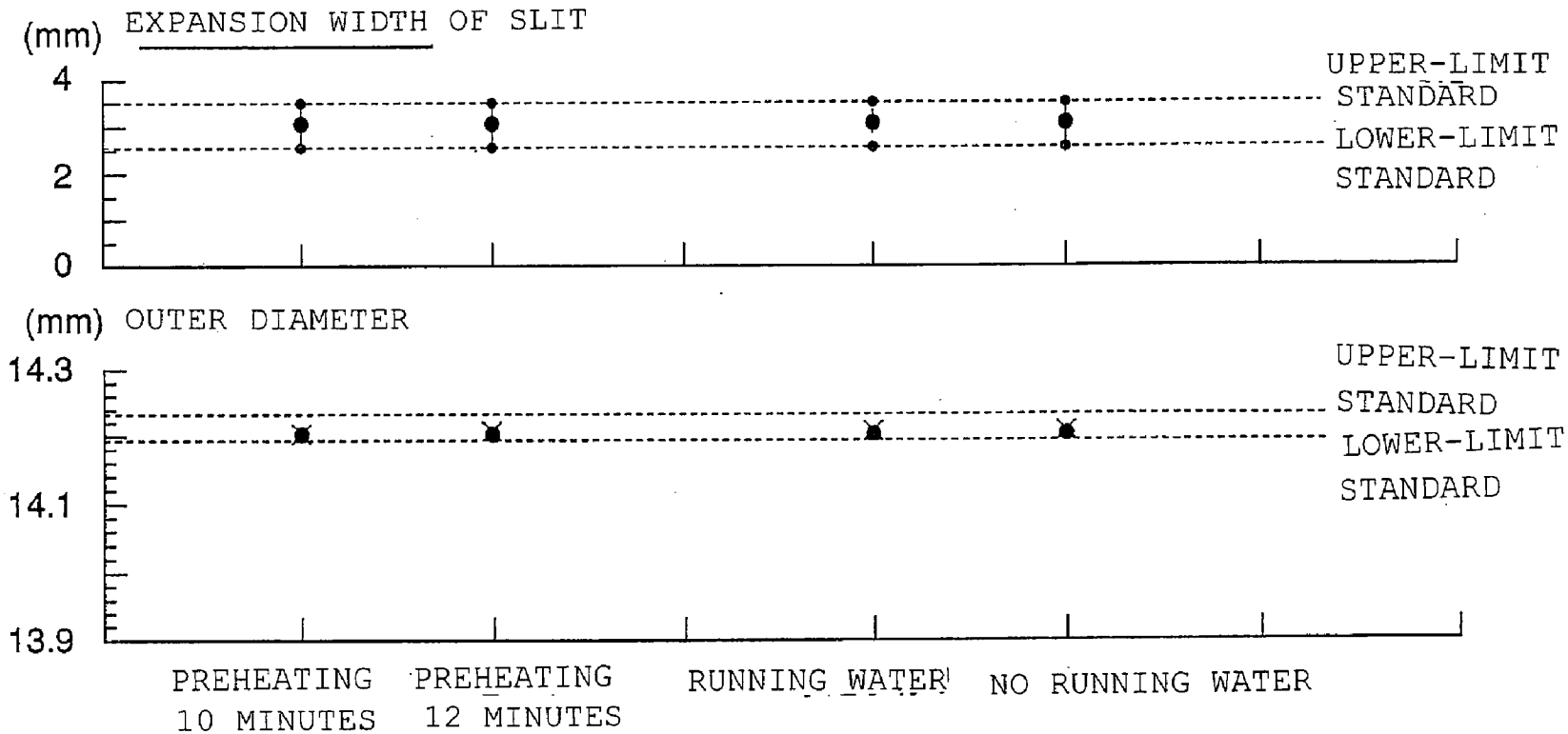
FIG. 34 is a graph showing results of Experimental Example 4.
Figure 35:
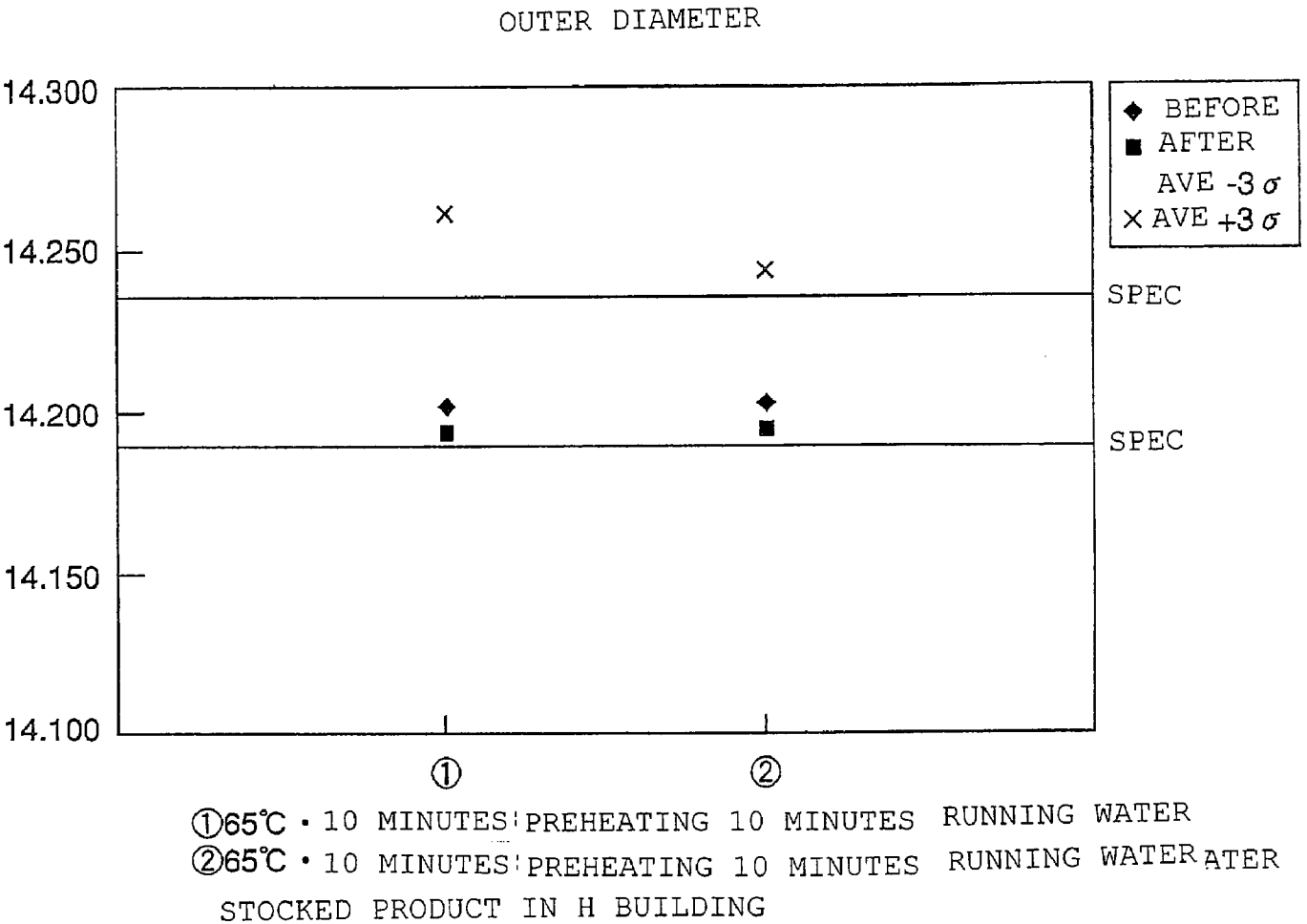
FIG. 35 is a graph showing results of Experimental Example 4.
Figure 36:
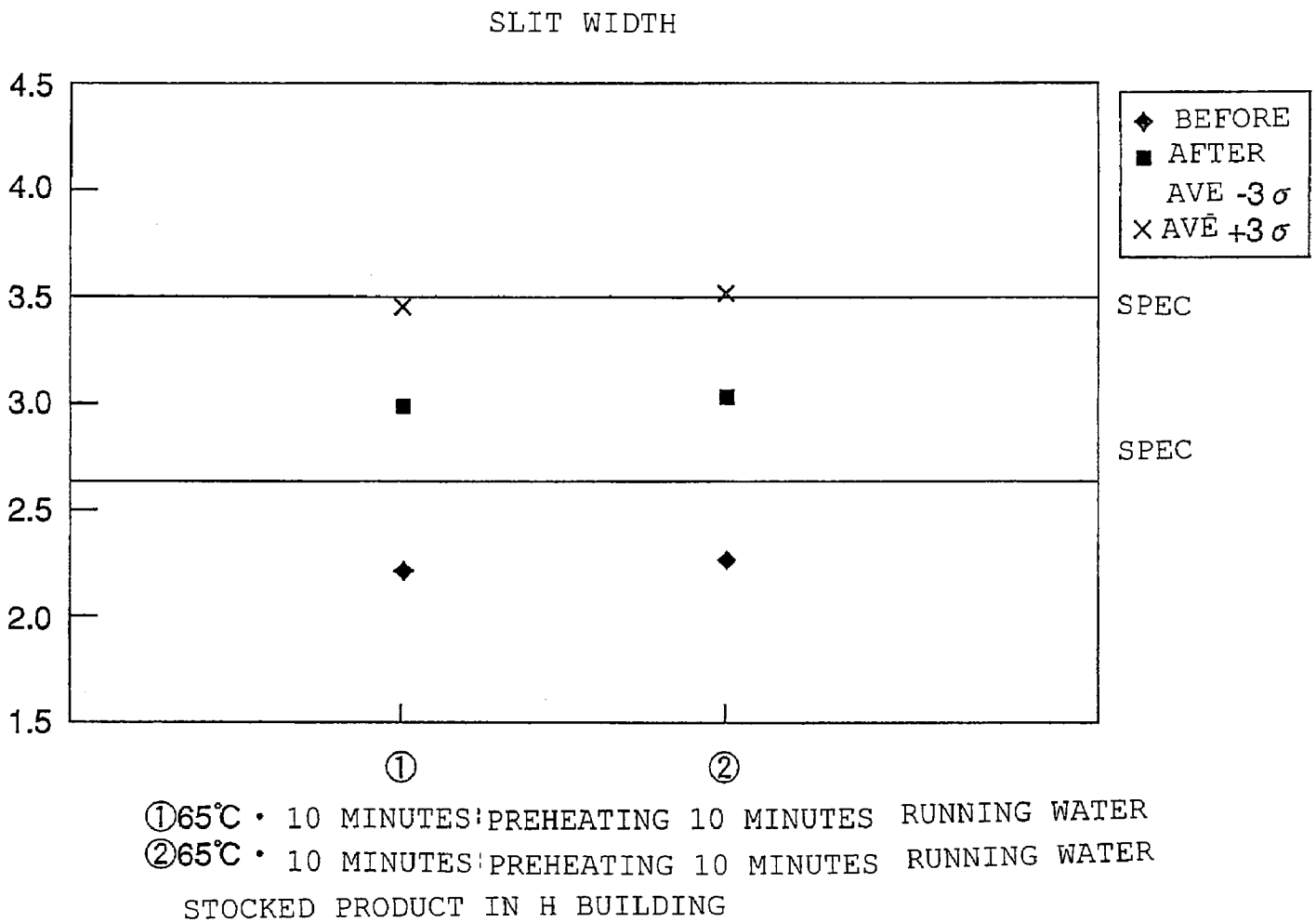
FIG. 36 is a graph showing results of Experimental Example 4.

FIGS. 34 to 36 show the results of Experimental Example 4.

As apparent from FIGS. 34 to 36, there is no difference between 10 minutes and 12 minutes as to the time for the preheating step, and between the case where the cooling step is performed after the heat-processing step and the case where the cooling step is not performed. Thus, it is found that the time for the preheating step can be set equal to the time for the heat-processing step while the cooling step can be eliminated.

EXPERIMENTAL EXAMPLE 5

Further, the present inventors performed the experiment in which it is confirmed whether the temperature and the time for the heat-processing step affect physical properties, particularly, a spring force in performing heat processing to the sound deadening member 74 as to the above-described recycling method of a part for an image forming apparatus. Note that, in Experimental Example 5, heat processing to the sound deadening member 74 is performed by not immersing the sound deadening member 74 in hot water but blowing hot air to the sound deadening member 74. Note that the spring force indicates the minimum load necessary for completely closing the opening portion 74A through application of a load that compresses the sound deadening member 74.

Figure 37:
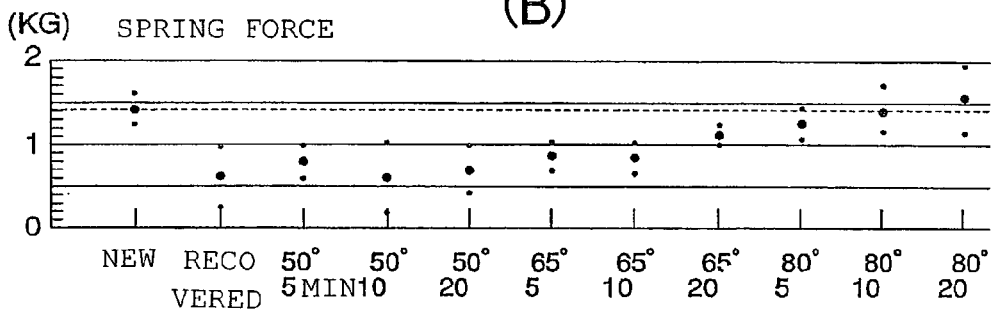
FIGS. 37A and 37B are charts showing Experimental Example 5.
Figure 38:
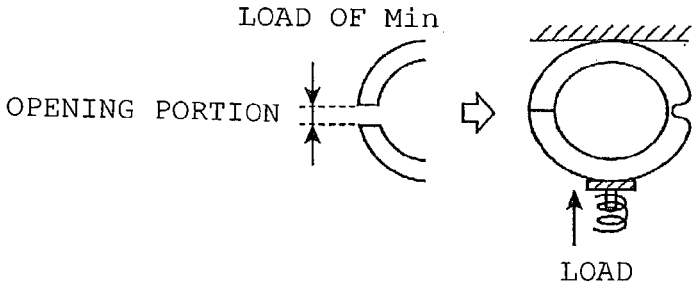
FIGS. 38A and 38B are charts showing Experimental Example 5.

FIGS. 37A and 37B show the results of Experimental Example 5.

As apparent from FIGS. 37A and 37B, there is a general tendency that the spring force of the sound deadening member 74 increases to the same level as that of the sound deadening member 74 as the temperature of hot air rises, and thus, the effect of heat processing is recognized. Further, the spring force increases as the processing time becomes longer. However, it is found that there is a case where the spring force of the sound deadening member 74 is larger in the case of a processing time of 5 minutes than in the case of a processing time of 10 minutes with a focus on only the spring force.

Figure 39:
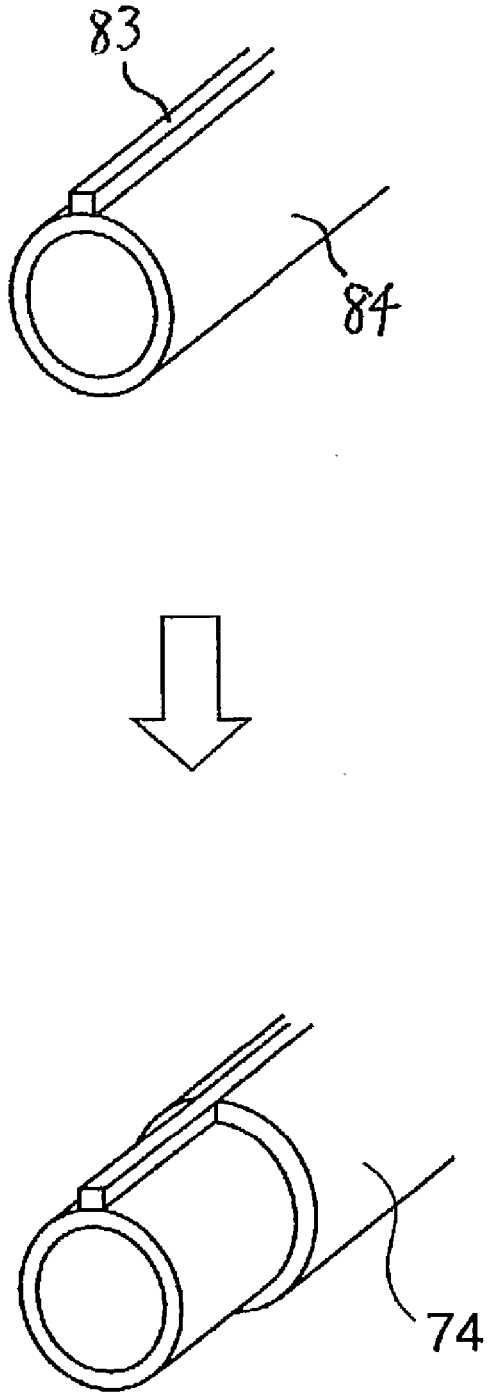
FIG. 39 is a structural view of another example of a correction jig.

Note that, as the correction jig 84 for heat processing, one with a cylindrical shape may be used as shown in FIG. 39.

Further, FIG. 40 is a chart for illustrating variation based on the actual measurement on the maximum outer diameter and the radius for new sound deadening members (silencers) 74 made of ABS just for reference.

Figure 41:
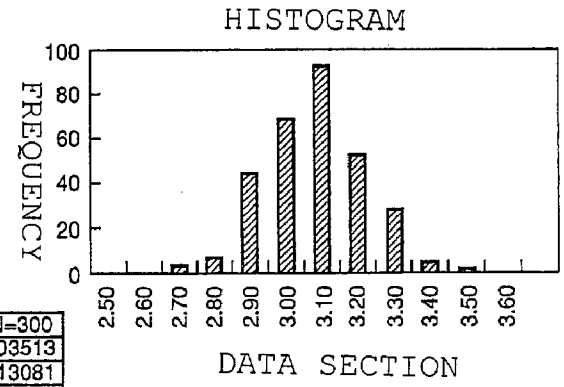
FIG. 41 is a chart showing measurement examples.

Further, FIG. 41 is a chart for illustrating change with time about the expansion width of the opening portion 74A of the recycled sound deadening member 74.

Figure 42:
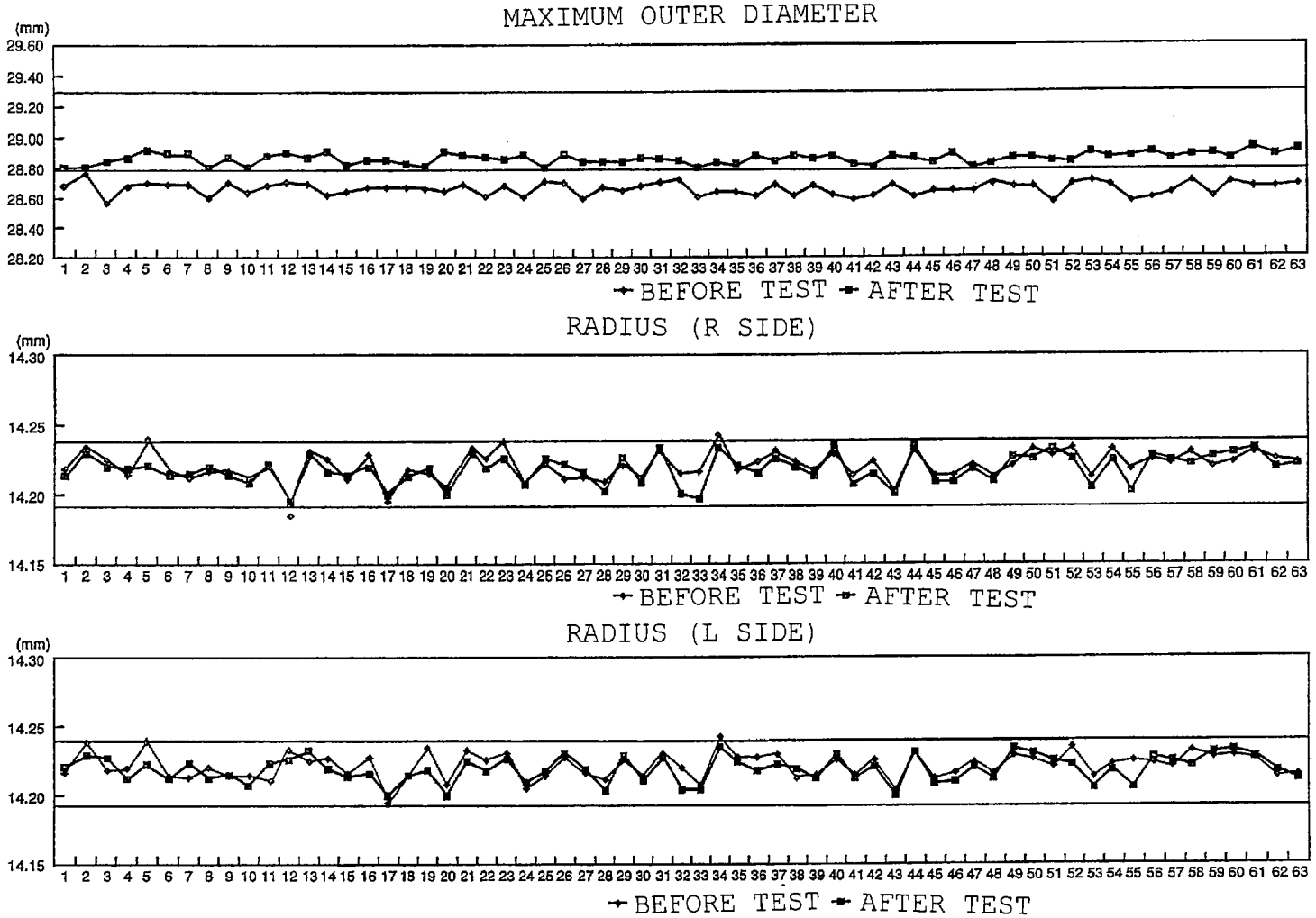
FIG. 42 is a graph showing measurement examples.

Moreover, FIG. 42 is a graph with sample numbers which shows the maximum outer diameter and the radius of the sound deadening member 74 under comparison between before and after the heat-processing step. FIG. 43 is a graph for illustrating change in dimensions of each portion of the sound deadening member 74 under comparison between before and after the heat-processing step. Note that FIGS. 30 and 31 are graphs showing data as the grounds for FIG. 42.

What is claimed is:

1. A recycling method of a part for an image forming apparatus, the part being used in the image forming apparatus and provided with a thermoplastic resin member at least in a part thereof, comprising:

recovering the used part for the image forming apparatus;

disassembling the recovered part for the image forming apparatus;

retrieving the thermoplastic resin member from the disassembled part for the image forming apparatus; and performing heat processing to the retrieved thermoplastic resin member to recycle the member by restoring original predetermined dimensions and shape within acceptable tolerances for reuse in a new part for the image forming apparatus.

2. A recycling method of a part for an image forming apparatus, the part being used in the image forming apparatus and provided with a thermoplastic resin member at least in a part thereof, comprising:

recovering the used part for the image forming apparatus;

disassembling the recovered part for the image forming apparatus;

retrieving the thermoplastic resin member from the disassembled part for the image forming apparatus;

preheating the retrieved thermoplastic resin member; and performing heat processing to the thermoplastic resin member to recycle the member after the preheating by restoring original predetermined dimensions and shape within acceptable tolerances for reuse in a new part for the image forming apparatus.

3. A recycling method of a part for an image forming apparatus according to claim 1, wherein:

the part for the image forming apparatus is a process cartridge; and the process cartridge is provided with a photosensitive drum that holds therein a sound deadening member as the thermoplastic resin member.

4. A recycling method of a part for an image forming apparatus according to claim 3, wherein the sound deadening member is formed as a cylinder member with a slit-like opening portion at a position in a circumferential direction thereof.

5. A recycling method of a part for an image forming apparatus according to claim 3, wherein the sound deadening member is formed as a hollow cylinder member with a hinge portion and a slit-like opening portion at opposite positions in a circumferential direction thereof.

6. A recycling method of a part for an image forming apparatus according to claim 3, wherein the sound deadening member is formed into a substantially C shape in section or a coil shape.

7. A recycling method of a part for an image forming apparatus according to claim 4, wherein heat processing is performed in a state in which the opening portion of the sound deadening member is expanded by a correction jig.

8. A recycling method of a part for an image forming apparatus according to claim 1, wherein the thermoplastic resin member is made of ABS resin or vinyl chloride resin.

9. A recycling method of a part for an image forming apparatus according to claim 1, wherein the heat processing is performed by immersing the thermoplastic resin member in hot water.

10. A recycling method of a part for an image forming apparatus according to claim 1, wherein:

the heat processing is performed by immersing the thermoplastic resin member in hot water; and the heat processing also serves as cleaning attachment attached to the thermoplastic resin member.

11. A recycling method of a part for an image forming apparatus according to claim 9, wherein the hot water is set at a temperature of 45° C. to 90° C.

12. A recycling method of a part for an image forming apparatus according to claim 9, wherein a temperature in the heat processing is set to a temperature equal to or less than a deflection temperature under load of the thermoplastic resin member.

13. A recycling method of a part for an image forming apparatus according to claim 4, further comprising examining a degree of restoration of the configuration of the sound deadening member with measurement of a width of the opening portion of the sound deadening member.

14. A recycling method of a part for an image forming apparatus according to claim 4, wherein, after a predetermined number of times of recycling of the sound deadening member is reached, a width of the opening portion of the sound deadening member is made larger for further recycling.

15. A recycling method of a part for an image forming apparatus according to claim 3, further comprising:

expanding an end portion of the photosensitive drum; and retrieving the sound deadening member from the photosensitive drum after the expanding.

* * * * *